US011944198B1

(12) United States Patent
Chan

(10) Patent No.: US 11,944,198 B1
(45) Date of Patent: Apr. 2, 2024

(54) ROCKING AND RECLINING SEATING APPARATUS

(71) Applicant: Alexander Chan, Alameda, CA (US)

(72) Inventor: Alexander Chan, Alameda, CA (US)

( * ) Notice: Subject to any disclaimer, the term of this patent is extended or adjusted under 35 U.S.C. 154(b) by 0 days.

(21) Appl. No.: 18/349,425

(22) Filed: Jul. 10, 2023

(51) Int. Cl.

| | |
|---|---|
| ***A47C 1/024*** | (2006.01) |
| ***A47C 1/034*** | (2006.01) |
| ***A47C 1/14*** | (2006.01) |
| ***A47C 3/025*** | (2006.01) |
| ***A47C 4/34*** | (2006.01) |
| ***A47C 4/44*** | (2006.01) |

(52) U.S. Cl.
CPC ..... *A47C 1/024* (2013.01); *A47C 1/0342* (2013.01); *A47C 1/14* (2013.01); *A47C 3/0255* (2013.01); *A47C 4/44* (2013.01); *A47C 4/34* (2013.01)

(58) Field of Classification Search
CPC ..... A47C 1/024; A47C 1/0342; A47C 1/14; A47C 3/0255; A47C 4/34
USPC ... 297/20, 21, 22, 23, 24, 25, 26, 27, 28, 29
See application file for complete search history.

(56) References Cited

U.S. PATENT DOCUMENTS 2,195,091 A * 3/1940 Lorenz ..... A47C 1/027 297/30
2,560,985 A * 7/1951 Rideout ..... A47C 1/0325 297/27
2,571,463 A * 10/1951 Lorenz ..... A47C 1/035 297/29
2,717,630 A 9/1955 Dowler
3,099,478 A * 7/1963 Pearlstine ..... A47C 4/40 297/29
4,072,341 A * 2/1978 Kurz ..... A47C 1/035 267/179
4,715,650 A * 12/1987 Berman ..... A47C 4/42 403/100
4,776,634 A * 10/1988 Pugliese ..... A47C 7/5066 297/359
4,792,181 A * 12/1988 Guichon ..... A47C 4/26 297/30
5,464,270 A * 11/1995 Chang ..... A47C 1/035 297/82

(Continued)

*Primary Examiner* — Rodney B White
(74) *Attorney, Agent, or Firm* — Kanika Radhakrishnan; Evergreen Valley Law Group

(57) ABSTRACT

Embodiments of the present disclosure disclose reclining seating apparatus with rocking and folding features. The seating apparatus includes a body support portion pivotally connected to a stationary frame, the body support portion including a seat member and a backrest member rotatably coupled with each other, the stationary frame including a first armrest and a second armrest supported by a leg structure. Further, the seating apparatus includes a pair of flexible members configured to adjust and control at least a rocking movement, a reclining movement, or a rocking-reclining movement of the body support portion. Each flexible members is configured to link one side of a seat with the side of a backrest member by passing through guide elements in the armrests in a configuration that transfers the weight of the user sitting on the seat to forward pressure on the backrest such that a user of the chair can easily press backward with the body to recline and when sitting more upright, the chair backrest automatically follows the body to a more upright position.

17 Claims, 16 Drawing Sheets

(56) References Cited

U.S. PATENT DOCUMENTS

| | | | | |
|---|---|---|---|---|
| 6,056,172 | A * | 5/2000 | Welsh | A47C 1/0265 224/155 |
| 6,517,152 | B1 * | 2/2003 | Chen | A47C 4/20 297/38 |
| 6,676,206 | B2 | 1/2004 | Brandschain | |
| 6,692,068 | B1 * | 2/2004 | Tang | A47C 1/03244 297/16.2 |
| 6,902,231 | B1 * | 6/2005 | Tseng | A47C 1/035 297/27 |
| 7,178,863 | B1 * | 2/2007 | Norval | A47C 4/20 297/29 |
| 7,407,229 | B1 | 8/2008 | Chen | |
| 7,500,715 | B1 * | 3/2009 | Chen | A47C 4/46 297/27 |
| 8,998,308 | B2 | 4/2015 | Chen | |
| 9,936,810 | B2 | 4/2018 | Lv | |
| 10,194,749 | B1 * | 2/2019 | Doolan | A47C 31/023 |
| 11,051,618 | B2 | 7/2021 | Chen | |
| 2002/0121800 | A1 * | 9/2002 | Yu | A47C 4/22 297/27 |
| 2002/0135210 | A1 * | 9/2002 | Tseng | A47C 1/0265 297/28 |
| 2003/0111872 | A1 * | 6/2003 | Zheng | A47C 4/44 297/16.2 |
| 2019/0045908 | A1 * | 2/2019 | Zhu | A45F 3/14 |
| 2020/0214450 | A1 * | 7/2020 | Garrison | A47C 7/624 |

* cited by examiner

ROCKING AND RECLINING SEATING APPARATUS

TECHNICAL FIELD

The present disclosure relates to a seating apparatus, more particularly to a rocking seating apparatus where the body support portion rocks forwards and backwards and to a reclining seating apparatus where the backrest can be adjusted to recline relative to the seat.

BACKGROUND

A chair is a kind of seating apparatus, which primarily consists of one or more legs, a seat, and back support. Chairs are widely used in various places like homes, offices, hospitals, schools, etc. To provide comfortable seating to the user, chairs are fabricated by considering, mainly two design aspects, firstly, technical aspects (e.g., strength, weight, etc.) and secondly, aesthetic aspects (e.g., shape, visual, etc.). To hold the heavy weight of a user and to improve stability while seating, chairs are made of heavy materials such as wood, metal, etc. Whereas, while considering the strength-to-weight ratio aspect, chairs are made using lightweight materials such as plastic, synthetic materials, etc.

Conventional chairs usually have a rigid structure. The rigid structure does not possess any degree of freedom, for example, one or more parts of the chair are fixed with other parts and become immobile. Thus, when the user sits on the chair, his/her body movements are constrained hence causing discomfort. Therefore, nowadays, chairs are modified in a manner that one or more parts can be moved as per the user's desire. For example, adjustable chairs are popular types of chairs for home and outdoor use. These adjustable chairs include reclining chairs, rocking chairs, and reclining rocking chairs. These chairs are complicated to manufacture because of the involvement of several components. Reclining chairs generally require spring mechanisms to support the moving backrest and to pull the backrest upright. Rocking chairs generally require curved sleds on the bottom to facilitate the rocking motion. Both are expensive components that add to the cost of adjustable chairs. Also, the assembly and disassembly of adjustable chairs are difficult and time-consuming.

Further, adjustable chairs are bulky and not compactable in design. Therefore, it is very difficult to transport the adjustable chairs from one place to another. Many adjustable and compact chairs currently available in the market are very expensive and use complex mechanisms to achieve required user comfort, compactness, and different seating positions. The different seating positions of the chair are not limited to upright normal position, rocking position, reclining position, or its combination. Therefore, there exists a need for a modified adjustable, reclining, and rocking chair that includes the least components with a simple mechanism of operation and offers ease in fabrication, assembly, and transportation.

SUMMARY

In order to solve the foregoing problem and to provide other advantages, one aspect of the present disclosure is to provide a rocking and reclining seating apparatus. The seating apparatus includes a body support portion suspended in a stationary frame. The body support portion includes a seat member and a backrest member. The bottom side of the backrest member is pivotally coupled to a back side of the seat member with a connection link, allowing the backrest member to attain a reclined position and an upright position, corresponding to the seat member. Secure members attached to first and second sides of the seat member and first and second sides of the backrest member connect are used to connect to flexible members.

The stationary frame of the seating apparatus includes a first armrest, a second armrest, and a leg structure. The first armrest and second armrests are located above the level of the seat on the first side of the seat member and the second side of the seat member respectively. A leg structure configured to hold the first armrest and the second armrest is comprised of a front leg frame pivotally coupled to a first portion of the first armrest and a first portion of the second armrest, and a back leg frame pivotally coupled to a second portion of the first armrest and a second portion of the second armrest. A first support member and a second support member are configured to link the first front leg member with the first back leg member and the second support member is configured at least to link the second front leg member with the second back leg member, said support members reinforcing the structure of the stationary frame in the open configuration and facilitating folding of the seating apply guiding one leg frame into the folded position while the other leg frame is being folded.

Further, the seating apparatus includes a pair of flexible members configured to adjust and control at least a rocking movement, a reclining movement, or a rocking-reclining movement of the body support portion. The first flexible member is configured to link the first side of the seat member with the first side of the backrest member by passing through the first armrest. The second flexible member is configured to link the second side of the seat member with the second side of the backrest member by passing through the second armrest.

In an aspect, the rocking and reclining seating apparatus includes a pivoting connection between the stationary frame and the body support portion which together with the first and second flexible members suspend the body support portion from the stationary frame.

In an aspect, the pivoting connection between the stationary frame and the body support portion is a rigid suspension element configured at least to restrict the movements of the seat member except for the rocking movement. The suspension element includes a first suspension member having a first end and a second end, a second suspension member having a first end and a second end, and a suspension crossbar having a first end and a second end, the second end of the first suspension member rigidly connected to the first end of the suspension crossbar and the second end of the second suspension member rigidly connected to the second end of the suspension crossbar to form a roughly U-shaped suspension element. The first end of the first suspension member is pivotally coupled to the second portion of the first armrest, the first end of the second suspension member is pivotally coupled to the second portion of the second armrest, thereby allowing the suspension element to swing forwards and backwards from the stationary frame and facilitating a rocking motion for the body support portion of the seating apparatus.

In an aspect, the second ends of the first and second suspension members pivotally connect to the body support portion at the first and second sides of the seat member at the first and second sides of the backrest member, first and second sides of the seat member, or the connection links between seat member and backrest member.

In an aspect, the body support portion comprises at least a frame structure, a flexible fabric, a rigid panel, or any combination thereof.

In an aspect, the rocking and reclining seating apparatus includes at least one first secure member disposed at each first side of the seat member and the second side of the seat member, and at each of the first side of the backrest member and the second side of the backrest member configured to at least hold the first flexible member and the second flexible member.

In an aspect, the rocking and reclining seating apparatus includes a plurality of guide elements positioned in the first armrest and the second armrest, configured at least to direct the first flexible member in the first armrest and at least to direct the second flexible member in the second armrest.

In an aspect, the rocking and reclining seating apparatus includes a mechanism such as a knob positioned in one or both of the armrests, configured at least to mobilize and immobilize the first flexible member and the second flexible member within the armrests to allow or halt the reclining motion of the backrest relative to the seat member.

In an aspect, the rocking and reclining seating apparatus includes a plurality of stoppers formed on each of the first flexible member and the second flexible member, configured at least to limit a recline angle between the seat member and the backrest member.

In an aspect, the flexible members linking the seat member and the backrest member eliminate the bulky, complicated and expensive spring mechanisms typical of most reclining chairs. The flexible member in this configuration transfers part of the weight that a user places on the seat member when sitting into forward pressure on the backrest member. This amount of pressure is regulated by the specific path of the flexible member so that the users of the seating apparatus can easily press backward with their bodies to recline, and the chair backrest automatically follows their bodies forward when returning to a more upright position. The use of flexible members also facilitates the ability of the body support portion to rock back and forth relative to the stationary frame.

In an aspect, the foldable rocking and reclining seating apparatus includes a footrest member pivotally connected to the front side of the seat member, a first push bar and a second push bar underneath the seat member, a first extension and a second extension extended from the bottom side of the backrest member, pivotally linked in a configuration such that when the backrest is reclined, the footrest extends from under the seat to a comfortable position to support a users feet.

In an aspect, the rocking and reclining seating apparatus is suspended from a stationary frame in which the leg frames fold relative to the armrests, and the chair can be folded into a compact portable configuration for storage or shipping.

In an aspect, the rocking reclining seating apparatus comprises a solid planar seat panel made of materials such as wood or plastic, or metal.

In an aspect, the rocking and reclining seating apparatus is suspended from a stationary frame that does not fold but can be disassembled by a user for portability, shipping, or efficient storage.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE FIGURES

The following detailed description of illustrative embodiments is better understood when read in conjunction with the appended drawings. To illustrate the present disclosure, exemplary constructions of the disclosure are shown in the drawings. However, the present disclosure is not limited to a specific device, or a tool and instrumentalities disclosed herein. Moreover, those in the art will understand that the drawings are not to scale.

Figure 1:
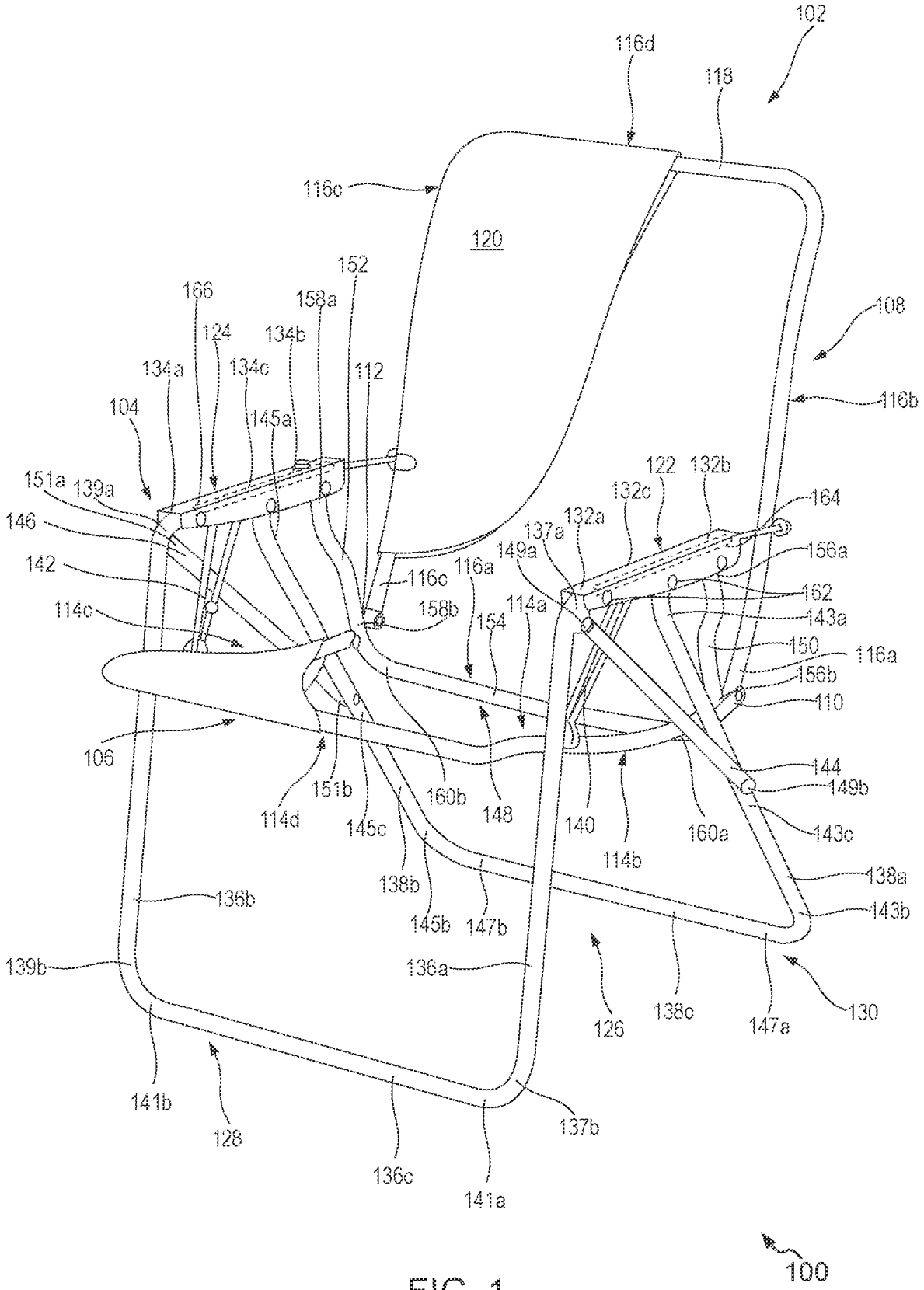
FIG. 1 illustrates a perspective view of a foldable rocking and reclining seating apparatus in an upright position, in accordance with an embodiment of the present disclosure.

The drawings referred to in this description are not to be understood as being drawn to scale except if specifically noted, and such drawings are only exemplary in nature.

DETAILED DESCRIPTION

In the following description, for purposes of explanation, numerous specific details are set forth in order to provide a thorough understanding of the present disclosure. It will be apparent, however, to one skilled in the art that the present disclosure can be practiced without these specific details. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein.

Reference in this specification to "one embodiment" or "an embodiment" means that a particular feature, structure, or characteristic described in connection with the embodiment is included in at least one embodiment of the present disclosure. The appearances of the phrase "in an embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but not for other embodiments.

Moreover, although the following description contains many specifics for the purposes of illustration, anyone skilled in the art will appreciate that many variations and/or alterations to said details are within the scope of the present disclosure. Similarly, although many of the features of the present disclosure are described in terms of each other, or in conjunction with each other, one skilled in the art will appreciate that many of these features can be provided independently of other features. Accordingly, this description of the present disclosure is set forth without any loss of generality to, and without imposing limitations upon, the present disclosure.

Various examples of the present disclosure describe seating apparatus comprised of a body support portion coupled with a stationary frame in such a manner that the body support portion possesses a rocking movement, a reclining movement, and a rocking-reclining movement with respect to the stationary frame.

The body support portion configured for seating a user includes a seat member and a backrest member rotatably coupled with each other through a connection link. The angular orientation between the seat member and the backrest member can be altered by the user sitting on the seat member by leaning back (straightening the body) to recline and by leaning forward (bending the waist) to return to an upright position. This motion is accomplished without expensive springs, levers, bulky mechanisms or motors typical of most reclining chairs on the market today. Forward pressure on the backrest that allows comfortable resistance to recline and then automatically comes forward when the user sits upright is provided by a unique combination of flexible members and pivoting joints that transfer some of the weight that a user places on the seat to forward pressure on the backrest. More specifically, flexible members connected to the first and second sides of the seat member are directed through guide elements in the first and second sides of the stationary frame and then connected to the first and second sides of the backrest member. Enhancements, such as locking mechanisms, added guide elements to increase friction, and various arrangements of the flexible member system of flexible members allow embodiments to be fine-tuned for maximum comfort and ease of reclining for the user.

Furthermore, when the pivoting joint between the stationary frame and the body support portion is enhanced to include a suspension member, the body support portion has the added feature to rock forwards and backwards and recline for added comfort.

Furthermore, other embodiments of the seating apparatus include components that can be folded into compact configurations convenient for shipping or storage.

Furthermore, other embodiments of the seating apparatus include components that can be disassembled into compact configurations convenient for shipping or storage.

Furthermore, an embodiment of the seating apparatus includes a footrest member adapted to provide support to the user's leg when the user pushes the backrest member into the reclined position. Various example embodiments of the present disclosure are described hereinafter with reference to FIG. 1 to FIG. 10.

FIG. 1 illustrates a perspective view of a foldable rocking and reclining seating apparatus 100 in an upright position, in accordance with an embodiment of the present disclosure. The foldable rocking and reclining seating apparatus 100 (also referred to as 'apparatus' or 'chair') includes a body support portion 102 suspended in a stationary frame 104. The body support portion 102 includes a seat member 106 and a backrest member 108. The body support portion 102 is constructed for comfortable seating of a user and designed in a manner to allow the user to possess more than one degree of freedom of movement. In other words, the body support portion 102 possesses a rocking movement, a reclining movement, and a rocking-reclining movement for the user.

The seat member 106 and the backrest member 108 are pivotally coupled with each other using a first connection link 110 and a second connection link 112. Specifically, the first connection link 110 couples a back portion 114*b* of the seat member 106 with a bottom end 116*a* of the backrest member 108. The second connection link 112 couples the back portion 114*c* of the seat member 106 with a bottom end 116*c* of the backrest member 108. The first connection link 110 and the second connection link 112 allow the seat member 106 and the backrest member 108 to fold compactly and adjust according to various reclining positions, based on the demand of the user. The geometrical configuration of the first connection link 110 and the second connection link 112 and its different embodiments to link the seat member 106 and the backrest member 108 are explained further in detail with respect to FIG. 3A and FIG. 3B.

In an illustrated embodiment, the seat member 106 and the backrest member 108, of the body support portion 102 are formed using a frame structure 118 wrapped with a flexible fabric 120. As shown, the flexible fabric 120 is partially stretched over the frame structure 118 for allowing the user to securely and comfortably seat in the body support portion 102. The frame structure 118 is designed to support the weight of the user. The externally applied load (i.e., the weight of the user) applied to frame structure 118 causes at least a shear force and a bending moment. Considering this design aspect, a suitable cross-section of the frame structure 118 can be chosen based on the applied load. In one embodiment, considering an aspect of safe design and ease of fabrication, the cross-section of the frame structure 118 can be chosen as circular. In another embodiment, the cross-section of the frame structure 118 may be chosen as a square or an elliptical, based at least on the weight of the user. Additionally, it should be noted that the frame structure 118 may be solid or hollow in shape, depending upon multiple factors, such as, but not limited to, the cost of material, the weight of the material, a factor of safety, or any other suitable design criteria. Considering these design aspects, frame structure 118 is preferably made up of metals, such as steel, aluminum, etc. Based on this, the preferred shape of the frame structure 118 for the seat member 106 and the backrest member 108 is shown in the illustrated embodiment (see, 118 of FIG. 1). However, the present disclosure is not limited to a specific shape of the frame structure 118, other embodiments of the shape of the frame structure 118 are also possible without limitation.

Further, as shown in FIG. 1, a flexible fabric 120 is used to cover the frame structure 118. The flexibility of the flexible fabric 120 is chosen, by aiming at least to provide minimum stiffness and maximum damping to the body of the user. The number of layers of the flexible fabric 120 used to cover the frame structure 118 depending upon one or more factors, like the weight of the user, stiffness, and damping required to the body of the user, etc. In the illustrated embodiment, the flexible fabric 120 is used to cover the frame structure 118. The material of the flexible fabric 120 is chosen based at least on durability, tearing strength, and aesthetic characteristics. In a non-limiting example, the flexible fabric 120 may be made of a plastic, cotton, or nylon material that satisfies the abovementioned design characteristics.

Further, the seating apparatus 100 includes a first armrest 122 and a second armrest 124. It is to be noted that, with respect to the position of the user, when seated on seating apparatus 100, the first armrest 122 and the second armrest 124 are located respectively on the left-hand side and right-hand side of the seat member 106. The first armrest 122 and the second armrest 124 are held rigidly off the ground surface, by a leg structure 126. The leg structure 126 includes a front leg frame 128 and a back leg frame 130. In the illustrated embodiment of the seating apparatus 100, the front leg frame 128 is pivotally coupled to a first portion 132*a* of the first armrest 122 and a first portion 134*a* of the second armrest 124. Whereas the back leg frame 130 is pivotally coupled to an intermediate portion 132*c* of the first armrest 122 and an intermediate portion 134*c* of the second armrest 124. The pivotal arrangement is such that the leg structure 126 may collapse with respect to the first armrest 122 and the second armrest 124, upon folding into a compact configuration. It is to be noted that the first portion 132*a* represents a front region, the intermediate portion 132*c* represents a center region, and a second portion 132*b* represents a back region of the first armrest 122 with respect to the position of the user when seated on the seating apparatus 100. Similarly, the first portion 134*a* represents a front region, the intermediate portion 134*c* represents a center region, and a second portion 134*b* represents a back region of the second armrest 124 with respect to the position of the user when seated on the seating apparatus 100. Those skilled in the art will understand that other leg frame arrangements are possible such as front and back leg frames both configured to attach to the center portion of the armrests, or crisscrossing leg frames where the front leg frame is attached to the rear portion of the armrest and the rear leg frame is attached to the front portion of the armrests. The geometrical configuration and the design aspect of the first armrest 122 are explained further in detail with respect to FIG. 3A and FIG. 3B.

Further, the front leg frame 128 includes a first front leg member 136*a*, a second front leg member 136*b*, and a front crossbar member 136*c*. As illustrated in FIG. 1, the first front leg member 136*a*, the second front leg member 136*b*, and the front crossbar member 136*c* are constructed to form an assembly of a U-shaped frame. An upper end 137*a* of the first front leg member 136*a* is pivotally coupled to the first portion 132*a* of the first armrest 122. Similarly, an upper end 139*a* of the second front leg member 136*b* is pivotally coupled to the first portion 134*a* of the second armrest 124. Whereas a lower end 137*b* of the first front leg member 136*a* is linked to a first end 141*a* of the front crossbar member 136*c* and a lower end 139*b* of the second front leg member 136*b* is linked to a second end 141*b* of the front crossbar member 136*c*. It is to be noted that the front crossbar member 136*c* is configured at least to provide support and prevent the chances of buckling of the first front leg member 136*a* and the second front leg member 136*b* when the user is seated on the seating apparatus 100. Therefore, based on the design criteria, multiple geometrical configurations of the front leg frame 128 is possible. In one configuration, the first front leg member 136*a*, the second front leg member 136*b*, and the front crossbar member 136*c* may be constructed to form an assembly of a trapezoidal-shaped frame that sustains the body weight of the user safely.

Further, the back leg frame 130 includes a first back leg member 138*a*, a second back leg member 138*b*, and a back crossbar member 138*c*. As illustrated in FIG. 1, the first back leg member 138*a*, the second back leg member 138*b*, and the back crossbar member 138*c* are constructed to form an assembly of a U-shaped frame. An upper end 143*a* of the first back leg member 138*a* is pivotally coupled to the intermediate portion 132*c* of the first armrest 122. Similarly, an upper end 145*a* of the second back leg member 136*b* is pivotally coupled to the intermediate portion 134*c* of the second armrest 124. Whereas a lower end 143*b* of the first back leg member 138*a* is linked to a first end 147*a* of the back crossbar member 138*c* and a lower end of 145*b* of the second back leg member 138*b* is linked to a second end 147*b* of the back crossbar member 138*c*. It is to be noted that the back crossbar member 138*c* is configured to at least provide support and prevent the chances of buckling of the first back leg member 138*a* and the second back leg member 138*b* when the user is seated on seating apparatus 100. Therefore, based on the design criteria, multiple geometrical configurations of the back leg frame 130 is possible.

When the user seats on the body support portion 102 of the seating apparatus 100, the user's body weight acts eccentrically on each of the first front leg member 136*a* of the front leg frame 128, the second front leg member 136*b* of the front leg frame 128, the first back leg member 138*a* of the back leg frame 130, and the second back leg member 138*b* of the back leg frame 130. The eccentric loading creates at least a compression, shearing, and bending of each of the abovementioned leg members. Considering these design aspects, the leg members of suitable size and shape are chosen. In one configuration, the leg members of a cylindrical shape may be used. In another configuration, the leg members may be formed using a square-shaped cross-section. In these configurations, the leg members may be solid or hollow in shape, depending upon the design of the seating apparatus 100. Based on the design, the material used for the leg members is preferably metal (e.g., steel), wood, or any other suitable material that safely sustains the user's body weight.

Further, the seating apparatus 100 includes a first support member 144 and a second support member 146, configured to connect the front leg frame 128 with the back leg frame 130. In particular, the first support member 144 is a link that connects the first front leg member 136*a* of the front leg frame 128 with the first back leg member 138*a* of the back leg frame 130. In the illustrated embodiment, an end 149*a* of the first support member 144 is pivotally linked to the upper end 137*a* of the first front leg member 136*a* of the front leg frame 128. Whereas, another end 149*b* of the first support member 144 is pivotally linked to the intermediate position 143*c* of the first back leg member 138*a* of the back leg frame 130. The arrangement provides support, distributes the load applied, and assists in the ease of the folding of the seating apparatus 100. As the front leg frame 128 is folded, the first and second support members 144, 146 push the back leg frame 130 into a folded position. Similarly, when the front leg frame 128 is opened for use, the first and second support members 144, 146 pull the back leg frame 130 into the open position. However, it should be noted that the arrangement of the first support member 144 is not limited to the arrangement described above. Another embodiment of the arrangement of the first support member 144 with respect to the first front leg member 136*a* of the front leg frame 128 and the first back leg member 138*a* of the back leg frame 130 is explained further in detail with respect to FIG. 2.

Similar to the first support member 144, the second support member 146 is a link that connects the second front leg member 136*b* of the front leg frame 128 with the second back leg member 136*b* of the back leg frame 130. In the illustrated embodiment, one end 151*a* of the second support member 146 is linked pivotally to the upper end 139*a* of the second front leg member 136*b* of the front leg frame 128. Whereas another end 151*b* of the second support member 146 is linked pivotally at the intermediate position 145*c* of the second back leg member 138*b* of the back leg frame 130. The arrangement at least provides support, distributes the load applied, and assists in the ease of the folding of the seating apparatus 100. However, it should be noted that the arrangement of the second support member 146 is not limited to the arrangement described above. Another embodiment of the arrangement of the second support member 146 with respect to the second front leg member 136*b* of the front leg frame 128 and the second back leg member 138*b* of the back leg frame 130 is explained further in detail with respect to FIG. 2.

Figure 2:
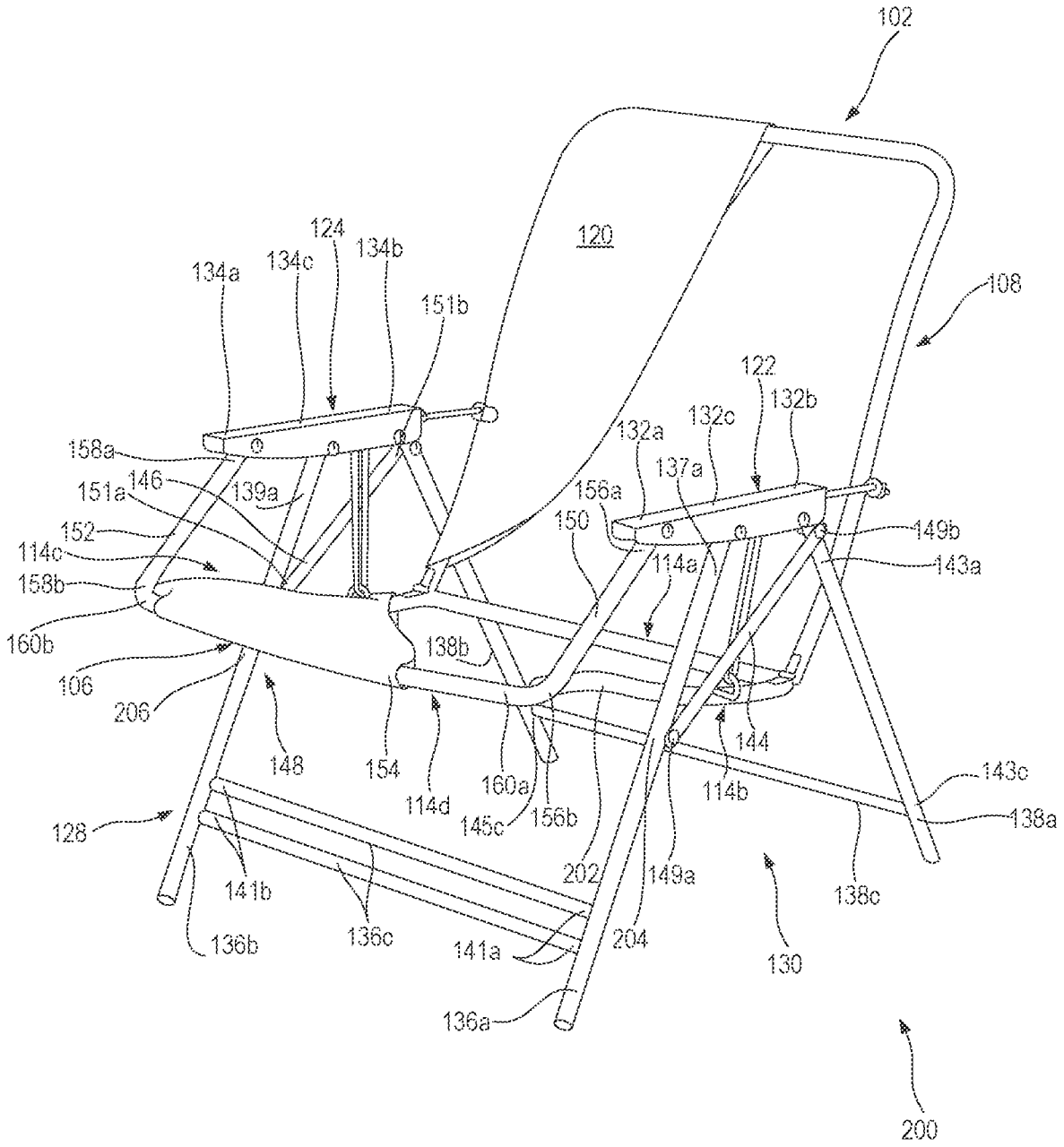
FIG. 2 illustrates a perspective view of the foldable rocking and reclining seating apparatus in the upright position, in accordance with another embodiment of the present disclosure.

The seating apparatus 100 further includes a pivoting connection that connects the stationary frame to the body support portion. In chair 100 this pivoting connection is suspension element 148. It should be noted that other configurations of the pivoting connection are possible as will be explored in detail when discussing FIG. 2 showing the suspension member 106 attached to the front of the armrest 122, 124, and FIG. 3B describing a fixed pivoting connection point between body support portion 102 and stationary frame 104. Suspension element 148 comprises the first suspension member 150, second suspension member 152, and suspension crossbar 154. In the illustrated embodiment, a first end 156*a* of the first suspension member 150 is pivotally coupled to the second portion 132*b* of the first armrest 122 and a first end 158*a* of the second suspension member 152 is pivotally coupled to the second portion 134*b* of the second armrest 124. Whereas a second end 156*b* of the first suspension member 150 is temporarily or permanently coupled with a first end 160*a* of the suspension crossbar 154, and a second end 158*b* of the second suspension member 152 is coupled with a second end 160*b* of the suspension crossbar 154, forming a U-shaped frame. The suspension element 148 facilitates a rocking movement and restricts lateral movement of the seat member 106 of the body support portion 102 relative to the stationary frame 104.

In the illustrated embodiment, the suspension crossbar 154 is positioned below the back side 114*a* of the seat member 106 and is attached to the connection link 110 on the left side and the connection link 112 on the right side. The suspension crossbar 154 provides support and stability to the user when seated on seat member 106 while allowing a front and back rocking motion. However, it should be noted that the suspension crossbar 154 can be positioned in other configurations also, based at least on the constraints to be provided to move the seat member 106 and the stability needed by the user when seated on the seating apparatus 100. In one configuration, the suspension element 148 can be rotatably attached to the back portion 114*a* of seat member 106. In yet another configuration, the suspension element 148 can be rotatably attached to the lower portions 116*a*,116*c* of the backrest member 108.

In another embodiment, the suspension element 148 can be located on the front side 114*d* of seat member 106, which is explained further in detail with respect to FIG. 2.

A rivet connection 162 in the seating apparatus 100 is configured to pivotally couple the components of the seating apparatus 100. In one embodiment, the pivotal connection 162 may include a single-headed or a double-headed rivet (not shown in FIG. 1). The heads of the rivet are designed in a manner to provide constraints to the connecting members to remove out of the rivet. A shank of the rivet (i.e., body of the rivet) is designed in a manner to act like a shaft that provides relative motion to one or more connecting members. To provide relative motion to the connecting member with respect to the shank of the rivet, clearance is provided. Further, to improve the tribological characteristics (i.e., friction coefficient and wear) of the shank of the rivet and the linked portion of the connecting member, a suitable lubricant such as grease, oil, etc., may be used. In another configuration, the shank of the pivot may be provided with a suitable coating (e.g., chromium coating) that reduces the wear and eliminates the chances of corrosion. In another embodiment, a hinge mechanism may be used as a pivotal coupling to link the connecting members. The hinge mechanism provides relative motion (e.g., tilting motion) to the connecting members for altering the geometric configuration and allowing the seating apparatus 100 to fold in partial and full mode.

Further, seating apparatus 100 includes a first flexible member 140 and a second flexible member 142. In an illustrated embodiment, the first flexible member 140 is configured to flexibly connect the first side 114*b* of the seat member 106 with the first side 116*b* of the backrest member 108 by passing through the first armrest 122. Similarly, the second flexible member 142 is configured to flexibly connect the second side 114*c* of the seat member 106 with the second side 116*c* of the backrest member 108 by passing through the second armrest 124. Each of the first flexible member 140 and the second flexible member 142 are arranged in a manner to adjust and control different movements of the body support portion 102. When a person sits on seat member 106, a portion of the person's weight is transferred from the seat, through flexible member 140 into forward pressure on backrest 106. The person, upon applying back pressure against the upper side 116*d* of the backrest member 108 can recline the backrest member 108 with respect to the seat member 106. When the person releases the back pressure against the upper side 116*d* by sitting more upright, the backrest member 108 is pulled forward automatically as the weight of the user is transmitted through flexible members 140,142 into forward pressure on the backrest. The movements controlled by the first flexible member 140 and the second flexible member 142 include at least a rocking movement, a reclining movement, or a rocking-reclining movement of the body support portion 102. The geometrical configuration of each of the rocking movements, the reclining movements, or the rocking-reclining movements of the body support portion 102 is explained further in detail with respect to FIG. 4A-4D.

FIG. 2 illustrates a perspective view of the foldable rocking and reclining seating apparatus 200 in the upright position, in accordance with another embodiment of the present disclosure. As shown, the suspension element 148 comprises the first suspension member 150, the second suspension member 152, and the suspension crossbar 154. The upper end 156*a* of the first suspension member 150 is pivotally connected to the forward portion 132*a* of first armrest 122, while the upper end 158*a* of the second suspension member 152 is pivotally connected to the forward portion 134*a* of the second armrest 124. The lower end 156*b* of suspension member 150 is rigidly connected to the first end 160*a* of suspension crossbar 106 while the lower end 158*b* of suspension member 152 is rigidly connected to the second end 160*b* of suspension crossbar 106 forming a U-shaped suspension element 148. The suspension crossbar 154 is also pivotally connected to the front ends of seat side frame 114*b* and seat side frame 114*c*. In this embodiment, the frame structure of seat member 106 comprises a U-shaped frame with a rear side frame 114*a* connected to seat side frame 114*a* at one end and seat side frame 114*c* at the other end.

It should be noted that based on this configuration, the upper end 137*a* of the first front leg member 136*a* of the front leg frame 128 is linked at the center portion 132*c* of the first armrest 122. Whereas the first back leg member 138*a* of the back leg frame 130 is linked at the rear portion 132*b* of the first armrest 122. The upper end 139*a* of the second front leg member 136*b* of the front leg frame 128 is linked at the center portion 136*c* of the second armrest 124. Whereas the second back leg member 138*b* of the back leg frame 130 is linked at the rear portion 134*b* of the second armrest 124.

Further, FIG. 2 illustrates another embodiment of the arrangement of the first support member 144, and the second support member 146. Since the second support member 146 is symmetrically identical in shape and fun to the first support member 144, only the details of first support member 144 are detailed here. The first support member 144 is configured to connect the first front leg member 136*a* of the front leg frame 128 with the first back leg member 138*a* of the back leg frame 130. As shown, one end 149*a* of the first support member 144 is pivotally linked to an intermediate position 204 of the first front leg member 136*a* of the front leg frame 128. Whereas another end 149*b* of the first support member 144 is pivotally linked at the upper end 143*a* of the first back leg member 138*a* of the back leg frame 130. The arrangement provides at least one support, distributes the load applied, and assists in the ease of the folding of the seating apparatus 200. As the front leg frame 128 is folded, the first and second support members 144, 146 pull the back leg frame 130 into a folded position. Similarly, when the front leg frame 128 is opened for use, the first and second support members 144, 146 push the back leg frame 130 into the open position. Furthermore, the first support member 144 provides the necessary strength and rigidity to resist the internal forces generated due to the transfer of load at least from the first armrest 122 and guide the forces to transmit safely to the ground through the first front leg member 136*a* of the front leg frame 128 and the first back leg member 138*a* of the back leg frame 130.

FIG. 2 shows a front leg frame 128 with two crossbars 136*c*. The first end 141*a* of the front crossbar member 136*c* can be linked to the intermediate position of the first front leg member 136*a* and the second end 141*b* of the front crossbar member 136*c* can be linked to the intermediate position of the second front leg member 136*b*, constructed to form an assembly of an H-shaped frame with multiple crossbars 136*c*. In another configuration, the front leg frame 128 having the first front leg member 136*a*, the second front leg member 136*b*, and the front crossbar member 136*c* may be fabricated to form a single unit, and no joints or connection points are provided.

In one configuration, the first back leg member 138*a*, the second back leg member 138*b*, and the back crossbar member 138*c* may be constructed to form an assembly of a trapezoidal-shaped frame that safely sustains the body weight of the user. In another configuration, the first end 147*a* of the back crossbar member 138*c* can be linked at an intermediate position 143*c* of the first back leg member 138*a* and the second end 147*b* of the back crossbar member 138*c* can be linked at an intermediate position 145*c* of the second back leg member 138*b*, constructed to form an assembly of an H-shaped frame. In yet another configuration, the back leg frame 130 having the first back leg member 138*a*, the second back leg member 138*b*, and the back crossbar member 138*c* may be fabricated in a manner to form a single unit, and no joints or connection points are provided.

In another embodiment, each side of leg structure 126 (not shown in FIGS. 1 and 2.), may be provided with more than one first support member 144 and more than one second support member 146. In a non-limiting example, two first support members 144 may be provided on each side of the leg structure 126 to connect the front leg frame 128 and the back leg frame 130 in a cross-arrangement manner. The arrangement of the one first support member 144 is already explained in detail with respect to FIG. 1, and therefore not reiterated for the sake of brevity. Also, the arrangement of the additional first support member 144 is already explained in detail with respect to FIG. 2, and therefore not reiterated for the sake of brevity. Therefore, the cross arrangement of the two first support members 144 and the cross arrangement of the two second support members 146 provides an additional factor of safety to the user by providing additional rigidity to the seating apparatus 100. The embodiments of the disclosure described in FIG. 1 are symmetric in geometric configuration with respect to the first side (i.e., left side) and the second side (i.e., right side) of the seating apparatus 100. Therefore, only the first side of the geometrical configuration and mechanism of operation of seating apparatus 100 will be described and the geometrical configuration and mechanism of operation of the second side of the seating apparatus 100 will not be reiterated for the sake of brevity.

Figure 3A:
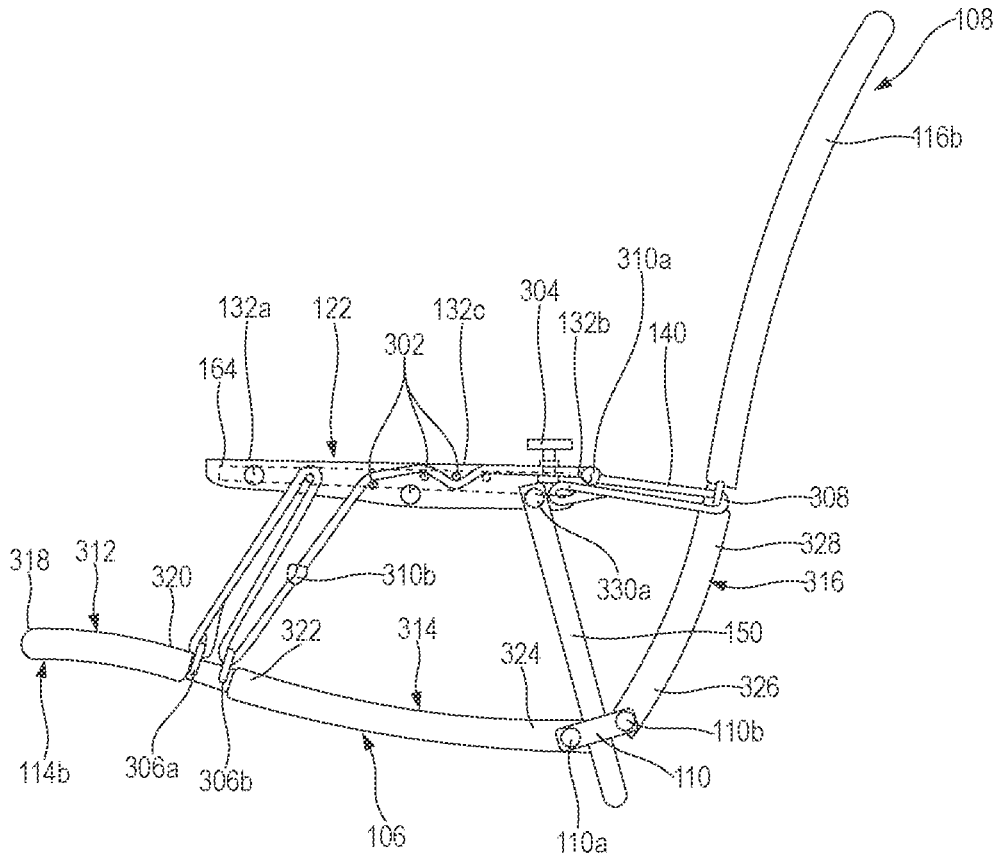
FIG. 3A illustrates a cutaway view of a first armrest with locking knob to control reclining, seat member, and a backrest member in accordance with an embodiment of the present disclosure with the stationary frame not shown for clarity.

FIG. 3A illustrates a cutaway view of the first armrest 122 of the seating apparatus 100 showing the, in accordance with an embodiment of the present disclosure. The first flexible member 140, connects the first side 114*b* of the seat member 106 with the first side 116*b* of the backrest member 108. The first armrest 122 is designed in a manner to position the user's hand comfortably. In one embodiment, considering the loading aspect of the design, the first armrest 122 may be made up of suitable materials like metal (e.g., steel) or non-metal (e.g., wood) that sustain the static and impact loading of the user. In another embodiment, the first armrest 122 may be made up of a soft material like rubber that provides maximum damping and minimum stiffness to the user's hand. The geometrical configuration of the first armrest 122 is formed in a manner that holds the user's hand. In a preferred embodiment, an outer envelope of the first armrest 122 is configured to hold the user's hand and an inner body is configured to accommodate one or more components.

As shown, a plurality of guide elements 302 is disposed of within a channel of the first armrest 122. The channel is the passage inside the first armrest 122 and the second armrest 124 through which the first flexible member 140 and the second flexible member 142 passes. Guide elements 302 are configured to guide the first flexible member 140 at least during the rocking movement, the reclining movement, and the rocking-reclining movement of the body support portion 102. Further, the guide elements 302 can be arranged systematically or zigzag pattern, depending on the required guiding movement of the first flexible member 140. In one embodiment, guide elements 302 may be made up of cylindrical bars over which the first flexible member 140 slides. The zig-zag pattern of cylindrical bars provides added friction for the flexible member 140 to slow the speed of recline of the backrest to a comfortable speed. In another embodiment, the guide elements 302 may form a shape of hooks over which the first flexible member 140 can slide along the length of the first armrest 122 only, and other movements of the first flexible member 140 are constrained.

The first armrest 122 further includes an example of a locking mechanism: a threaded knob 304, configured to mobilize and immobilize within the armrest 122 the first flexible member 140 connecting the first side 114*b* of the seat member 106 with the first side 116*b* of the backrest member 108. In the illustrated embodiment, the threaded knob 304 is provided at the second portion 132*b* of the first armrest 122. The threaded knob 304 includes a cylindrical bar whose bottom end is disposed of with a disc and the upper end is provided with a handle. The handle is configured at least to provide twisting movement to the cylindrical bar of the threaded knob 304. For the ease of the rotation of the cylindrical bar with respect to the first armrest 122, a bearing is provided. As the first flexible member 140 passes tangentially with the outer surface of the cylindrical bar of the threaded knob 304, a part of the first flexible member 140 gets tightened due to contact with the cylindrical bar. In one example, the user twists the handle in a clockwise direction to tighten the first flexible member 140 and twists the handle in an anti-clockwise direction to loosen the first flexible member 140. The tightening and the loosening of the first flexible member 140 assists in fixing the flexible member 140 within the armrest 122 and thus stopping the reclining movement of the body support portion 102. However, even when the flexible member 140 is locked, the body support portion can be rocked. It should be noted that a rocking but not reclining seating apparatus can be produced by incorporating a permanent lock 304 to immobilize the flexible member 140 within the arm.

In another embodiment, more than one threaded knob 304 can be used to mobilize and immobilize the first flexible member 140 connecting the first side 114*b* of the seat member 106 with the first side 116*b* of the backrest member 108. The position of the threaded knob 304 in the first armrest 122 is decided, based at least on technical aspects (e.g., tightening and the loosening intensity of the first flexible member 140) and aesthetic aspects (e.g., shape, visual, etc.) of the design.

In one embodiment, the locking mechanism includes a spring (not shown) that pushes an end of the lever, to immobilize the first flexible member 140 by wedging the first flexible member 140 between the plurality of guide elements 302. This prevents the first flexible member 140 from gliding across the glides and locks the backrest 108 in place relative to the seat supporting member 106. When a person pulls the lever, the wedge is released from its locking position and the first flexible member 140 is allowed to smoothly travel past the plurality of guide elements 302 and the users can assume a more reclined or upright position with the backrest member 108 following the motion of the user's body to provide support. When a person releases the lever, the flexible member 140 is locked in position relative to the armrests 122, 124 and the seating apparatus will retain a fixed recline position for stability and comfort.

Further, one or more first secure members 306*a* and 306*b* are disposed of within the body of the first side 114*b* of the seat member 106. The secure members 306*a* and 306*b* are configured at least to hold or allow the sliding of the first flexible member 140. In the illustrated embodiment, as shown in FIG. 3A, the one first secure member 306*a* is designed to hold the first end of the first flexible member 140. Therefore, for safe design, the first secure member 306*a* is configured to sustain a pulling force applied by the first flexible member 140. Whereas another first secure member 306*b* is configured to provide a sliding movement to the first flexible member 140. In one embodiment, the first secure members 306*a* and 306*b* may be a ring that is made up of a suitable material (like mild steel) that sustains at least a tensile loading applied by the first flexible member 140. The ring may have a circular shape, a square shape, or any other suitable shape that satisfies the technical aspects and aesthetic aspects of the design. In another embodiment, a hook may be temporarily disposed of within the body of the first side 114*b* of the seat member 106 to satisfy the functionality of the first secure members 306*a* and 306*b*.

Similarly, a second secure member 308 is disposed of within the body of the first side 116*b* of the backrest member 108. The second secure member 308 is configured at least to hold or allow the sliding of the first flexible member 140. In the illustrated embodiment, as shown in FIG. 3A, the second secure member 308 is designed to provide sliding movement to the first flexible member 140. In one embodiment, the second secure member 308 may be the ring which is made up of a suitable material (like mild steel) that sustains at least a pulling force of the first flexible member 140. The ring may form a circular shape, a square shape, or any other suitable shape that satisfies the technical aspects and aesthetic aspects of the design. In another embodiment, a hook may be temporarily disposed of within the body of the first side 116*b* of the backrest member 108 to satisfy the functionality of the second secure member 308.

Further, the first flexible member 140 and the second flexible member 142 facilitate relative motion between the seat member 106 and the backrest member 108. In an embodiment, one or more hinges may act as the first connection link 110 and the second connection link 112 to form a coupling between the seat member 106 and the backrest member 108. The seat member 106 and the backrest member 108 connected by the hinge cause tilting motion relative to each other about a fixed axis of rotation. It should be noted that all other translations or rotational motions are constraints and thus, the hinge provides only one degree of freedom to the backrest member 108. The hinge may be made of materials that are flexible and capable of withstanding frictional force and torsional shear stress applied on the pivot. The pivot is also designed considering the aspect of bending load applied by the user during reclining. The rotary coupling may include, but is not limited to, latching members or any other suitable engagement means. The hinge connector is capable of providing smooth and repeatable motion.

When the backrest member 108 is pushed rearward, seat member 106 is lifted upward by the first flexible member 140 and when the backrest member 108 is moved forward, the seat member 106 is allowed to tilt downward by the first flexible member 140. The first flexible member 140 in this configuration transfers part of the weight of a user pressing down onto the seat into forward pressure on the backrest member 108. The amount of pressure is regulated by the specific path of the first flexible member 140 so that the user of the seating apparatus 100 can easily press backward with the body to recline, and when the user sits more upright, the backrest member 108 automatically follows the body to a more upright position.

Further, as shown in FIG. 3A, the first flexible member 140 is configured to link the first side 114*b* of the seat member 106 with the first side 116*b* of the backrest member 108 by passing through the first armrest 122. One end of the first flexible member 140 loops from the channel of the first armrest 122 to seat member 106 with three lengths. Whereas the other end of the first flexible member 140 loops from the channel of the first armrest 122 to the backrest member 108 with two lengths. In this case, the tension holding the back from reclining will be approximately ⅔rd the weight that the person applies on the front of the seat member 106. A person applying 36 kilograms of pressure to the front of seat member 106 would feel back pressure of about 24 kilograms to recline the backrest member 108. Thus, by varying the number of times that the first flexible member 140 loops back and forth from the first armrest 122 to the seat member 106 and backrest member 108, the exact pressure required to recline the backrest member 108 can be fine-tuned for maximum comfort. FIG. 3 shows a configuration in which the back pressure was two-thirds as strong as the downward seat pressure. Other configurations are also possible. Considering if the first flexible member 140 was directly anchored to the seat member 106 and traveled directly through the first armrest 122 (with no loops) directly to the backrest member 108 where it was again anchored, the backrest member 108 would exert a forward force equal to the weight applied on the seat member 106 which would make the backrest difficult if not impossible for most users to recline.

Within the channel of the first armrest 122, the first flexible member 140 is directed through a series of guide elements 302 which direct the first flexible member 140 towards the back of the seating apparatus 100. Guide element 302 closest to the first portion 132*a* of the first armrest 122 is the anchor point where one end of the first flexible member 140 is tied. Also, guide elements 302 add friction to the first flexible member 140 to control the speed and pressure at which the backrest member 108 reclines and moves forward.

Further, the first flexible member 140 includes a plurality of stoppers, for example, a first stopper 310*a* and a second stopper 310*b*, located at least at ends and at intermediate points configured at least to control a reclined angle between the seat member 106 and the backrest 108. The first stopper 310*a* limits the backrest member 108 from being pulled uncomfortably forward as the backrest 108 will only be pulled forward until stopper 310*a* contacts the rear portion 132*b* of armrest 122. The second stopper 310*b* controls how far back the backrest member 108 is allowed to recline as the back will not recline further after stopper 310*b* contacts the underside of armrest 122 at guide element 302.

Figure 3B:
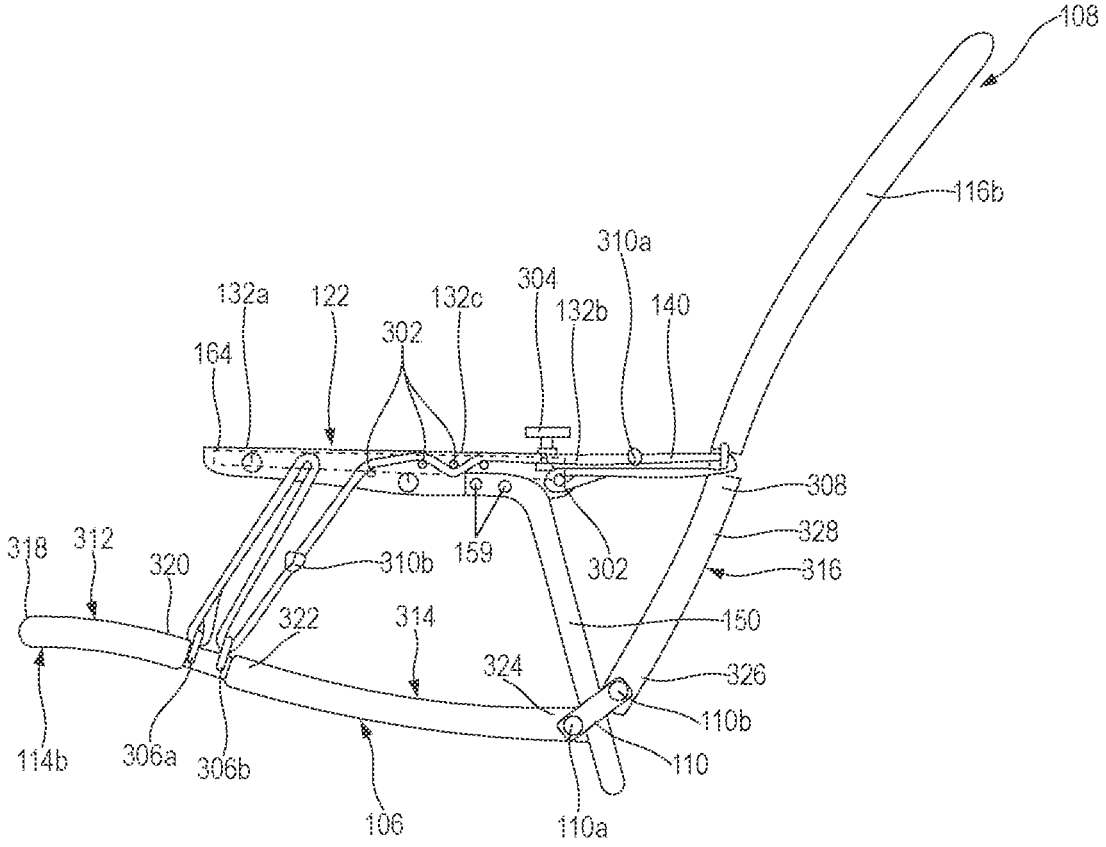
FIG. 3B illustrates a cutaway view of the first armrest, seat member, and the backrest member with the suspension member fixed in relation to the armrest, in accordance with an embodiment of the present disclosure with the stationary frame not shown for clarity.

FIG. 3B shows a cutaway view of the first armrest, seat member, and the backrest member with the suspension member fixed in relation to the armrest. FIGS. 1 and 2 both depict seating apparatus in which the body support portion 102 suspended from the stationary frame 104 has the ability to rock back and forth relative to the stationary frame and for the backrest 108 to recline relative to the seat member 106. It should be noted that the seating apparatus 100 can also be constructed as a reclining chair without a rocking feature. This is accomplished by locking the connection point between the body support portion 102 and the stationary frame 104 at a fixed location relative to the stationary frame 104 thereby not allowing the seat member 106 to rock back and forth relative to the stationary frame. In FIG. 3B, the suspension member 150 is attached to the armrest 122 with 2 rivets 159 so that the suspension member 150 cannot rotate in relation to the armrest 122, thereby preventing seat member 106 from rocking back and forth. Note that the arrangement of the suspension member 140 still allows the backrest 108 to recline relative to the seat member 106. Connection link 110 still allows the backrest 108 to pivot relative to the seat member 106.

While not illustrated, the chair depicted in FIG. 2 can also have the suspension member 150 fixed to the armrest 122 so that the chair can have a reclining motion but not a rocking motion. One skilled in the art will understand that the pivoting connection between the stationary frame 104 and body support portion 102 can be anywhere along the side of seat member 106 or bottom portion of the backrest 108 as long as the connection incorporates a pivot such as in connection link 110 that allows the seat 106 to pivot. Such a pivoting connection can even be attached directly to the stationary frame 102 (for instance to the rear leg frame 126) bypassing the need for a suspension element when a rocking feature is not desired.

FIGS. 4A, 4B, 4C, and 4D illustrate the preferred configuration of the flexible member 140 to provide the maximum comfort and ease of reclining and sitting upright for the user. FIGS. 4A, 4B, 4C, and 4D show the first flexible member 140 anchored to the intermediate portion 132*c* of the first armrest 122. From there, the first flexible member 140 extends downwards to the seat member 106 through secure member 306*a*, and 306*b* and then returns upwards to the first armrest 122, around guide elements 302, and rearwards out of the first armrest 122 finally anchoring at the secure element 308 on the backrest member 108. This configuration results in a two-to-one force ratio of weight on the seat member 106 from the user to forward pressure from the backrest member 108 on the user's back. From testing with prototypes with users of varying weights and heights, this ratio is comfortable for users of all weights to recline the backrest member 108 with minimal effort simply by leaning back. When users wish to sit more upright, they simply bend forward at the waist and their weight on the seat pulls the backrest member 108 forward to assist in sitting upright.

Furthermore, the linkage of the seat member 106 to the backrest member 108 with the first and second flexible members 140 and 142 inherently adapts to each unique user. A heavy user places greater weight on the seat member 106 of the seating device 100 and therefore feels stronger support from the back, while a lighter user will have less pressure on the seat member 106 and have lighter pressure from the backrest member 108. A heavy user who places 75 kilograms of weight on the front portion of seat member 106 will feel approximately 37 kilograms of forward pressure from backrest member 108. A lighter user who places 30 kilograms of weight on the front portion of seat member 106 will feel approximately 15 kilograms of forward pressure from the backrest member 108. This tuning of the force required to recline the back relative to the weight of a person is an improvement in comfort to traditional spring mechanisms that are used in reclining chairs and are set at the factory and cannot be changed to accommodate different weights of users. Directing the first and second flexible members 140 and 142 through a specific pathway of guide elements 302 controls the pressure required to recline the backrest 108 as well as controls the speed at which the backrest 108 reclines. This is accomplished without springs, levers, or other complicated or expensive to manufacture mechanical devices.

The cross-sectional area and length of the first flexible member 140 are designed based at least on a tensile load applied during the operation. The tensile load includes the load applied due to the user's body weight. Based on the loading condition, in one embodiment, a rope can be used as the first flexible member 140. The rope may be made up of a suitable material like nylon that sustains extreme head load and possesses superior shock resistance. In another embodiment, a flexible strap (e.g., belt) may be used as the first flexible member 140.

Now, again referring to FIG. 1, the seating apparatus 100 is in the open state with the body support portion 102 in an upright position. In the configuration shown in FIG. 1, the body support portion 102 is in the neutral rocking position. However, it is to be noted that the body support portion 102 is designed in a manner to form a configuration in a forward rocking position or backward rocking position. Different possible configurations of the seating apparatus 100 are described below.

Figure 4A:
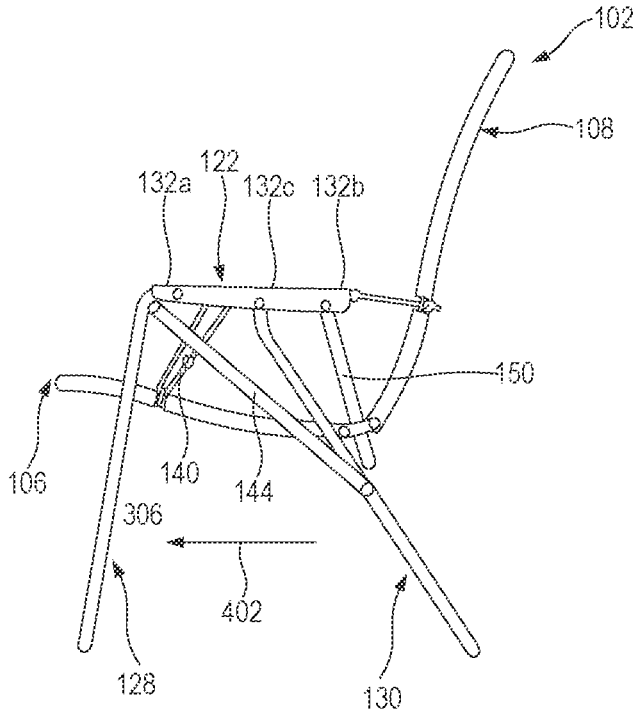
FIG. 4A illustrates a side view of the foldable rocking and reclining seating apparatus of FIG. 1 in a forward rocking position with the back in an upright position, in accordance with an embodiment of the present disclosure.

FIG. 4A illustrates a side view of a foldable rocking and reclining seating apparatus of FIG. 1 with the body support portion 102 in a forward rocking position relative to the stationary frame 104 comprising front leg frame 128, back leg frame 130 and armrest 122. FIG. 4A also shows that the body support portion 102 is not reclined and in the upright position. The details of the first flexible member 140 and the suspension member 150 which determine this position is explained in further detail with respect to FIG. 5A.

Figure 4B:
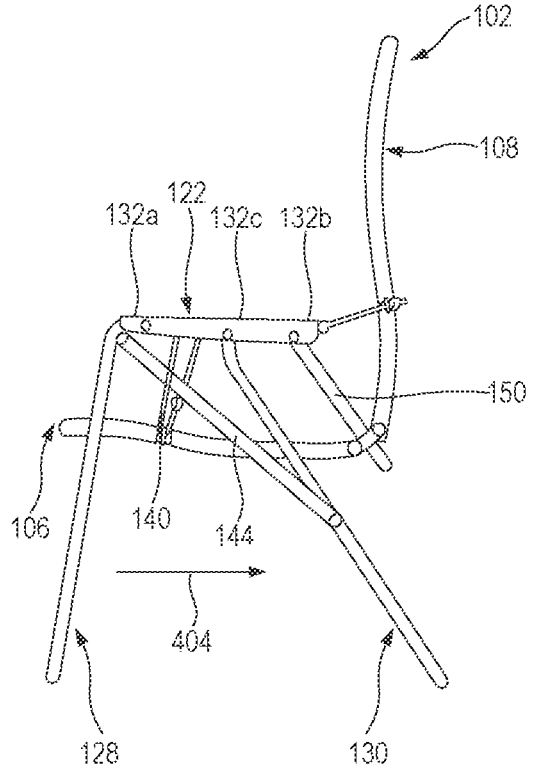
FIG. 4B illustrates a side view of the foldable rocking and reclining seating apparatus of FIG. 1 in a rearward rocking position with the back in an upright position, in accordance with an embodiment of the present disclosure.

FIG. 4B illustrates a side view of a foldable rocking and reclining seating apparatus of FIG. 1 with the body support portion 102 in a rearward rocking position relative to the stationary frame 104 comprising front leg frame 128, back leg frame 130 and armrest 122. FIG. 4A also shows that the body support portion 102 is not reclined and in the upright position. The details of the first flexible member 140 and the suspension member 150 which determine this position is explained in further detail with respect to FIG. 5B.

Figure 4C:
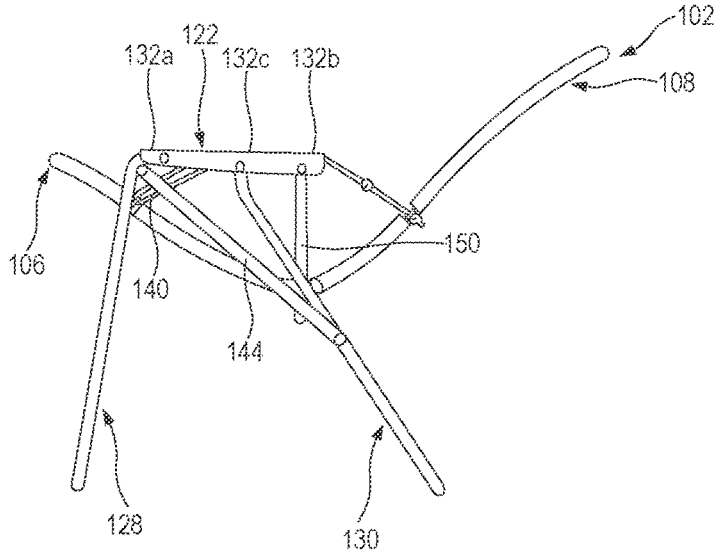
FIG. 4C illustrates a side view of the foldable rocking and reclining seating apparatus of FIG. 4A in a forward rocking position with the backrest in a fully reclined position, in accordance with an embodiment of the present disclosure.

FIG. 4C illustrates a side view of a foldable rocking and reclining seating apparatus of FIG. 1 with the body support portion 102 in a forward rocking position relative to the stationary frame 104 comprising front leg frame 128, back leg frame 130 and armrest 122. FIG. 4A also shows that the body support portion 102 is in the reclined position. The details of the first flexible member 140 and the suspension member 150 which determine this position is explained in further detail with respect to FIG. 5C.

Figure 4D:
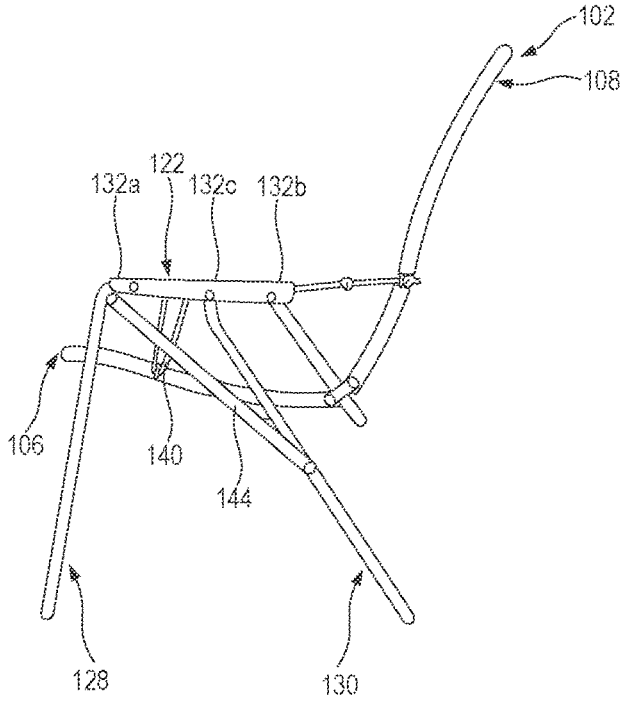
FIG. 4D illustrates a side view of the foldable rocking and reclining seating apparatus of FIG. 4B in a rearward rocking position with the backrest in a fully reclined position, in accordance with an embodiment of the present disclosure.

FIG. 4D illustrates a side view of a foldable rocking and reclining seating apparatus of FIG. 1 with the body support portion 102 in a rearward rocking position relative to the stationary frame 104 comprising front leg frame 128, back leg frame 130 and armrest 122. FIG. 4A also shows that the body support portion 102 is in the reclined position. The details of the first flexible member 140 and the suspension member 150 which determine this position is explained in further detail with respect to FIG. 5C.

Figure 5A:
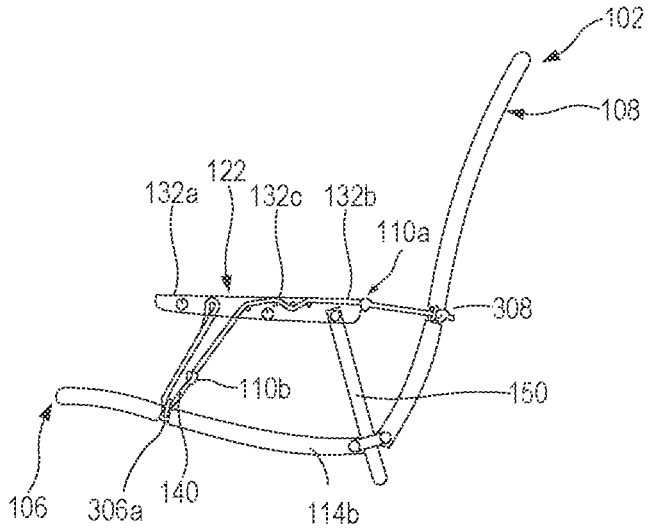
FIG. 5A illustrates a cutaway view of the first armrest described in FIG. 4A, in accordance with an embodiment of the present disclosure.

FIG. 5A illustrates a cutaway view of the first armrest described in FIG. 4A, in accordance with the embodiment of the present disclosure. For clarity, the front leg frame 128 and the back leg frame 130 are shown in FIG. 4A is not shown in FIG. 5A. In the forward rocking position, as the body support portion 102 moves forward with respect to the armrest 122 the suspension member 150 rotates forwards towards the front of the seating apparatus. In the upright position, the linear distance between the second portion 132*b* of the first armrest 122 and the second secure member 308 of the backrest member 108 is decreased until stopper 110*a* contacts the rear portion 132*b* of armrest 122 and limits the upright motion of the backrest 108. Correspondingly, the lateral distance between the first portion 132*a* of the first armrest 122 and the one first secure member 306*a* of the first side 114*b* of the seat member 106 is increased.

Figure 5B:
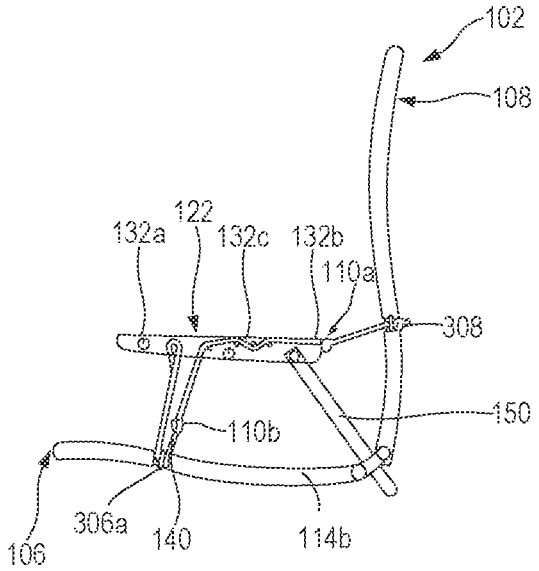
FIG. 5B illustrates a cutaway view of the first armrest described in FIG. 4B, in accordance with an embodiment of the present disclosure.

FIG. 5B illustrates a cutaway view of the first armrest described in FIG. 4B, in accordance with the embodiment of the present disclosure. For clarity, the front leg frame 128 and the back leg frame 130 are shown in FIG. 4B is not shown in FIG. 5B. In the rearward rocking position, as the body support portion 102 moves rearward with respect to the armrest 122, the suspension member 150 rotates rearward towards the back of the seating apparatus. In the upright position, the linear distance between the second portion 132*b* of the first armrest 122 and the second secure member 308 of the backrest member 108 is decreased until stopper 110*a* contacts the rear portion 132*b* of armrest 122 and limits the upright motion of the backrest 108. Correspondingly, the lateral distance between the first portion 132*a* of the first armrest 122 and the one first secure member 306*a* of the first side 114*b* of the seat member 106 is increased.

Figure 5C:
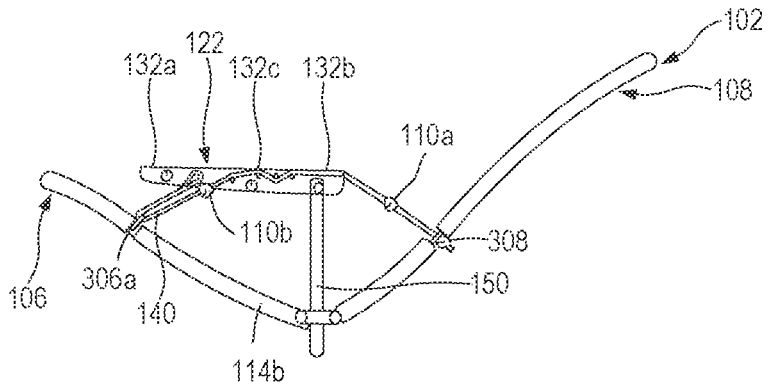
FIG. 5C illustrates a cutaway view of the first armrest described in FIG. 4C, in accordance with an embodiment of the present disclosure.

FIG. 5C illustrates a cutaway view of the first armrest described in FIG. 4C, in accordance with the embodiment of the present disclosure. For clarity, the front leg frame 128 and the back leg frame 130 are shown in FIG. 4C is not shown in FIG. 5C. In the forward rocking position, as the body support portion 102 moves forward with respect to the armrest 122 the suspension member 150 rotates forwards towards the front of the seating apparatus. In the reclined position, the linear distance between the second portion 132*b* of the first armrest 122 and the second secure member 308 of the backrest member 108 is increased. Correspondingly, the lateral distance between the first portion 132*a* of the first armrest 122 and the one first secure member 306*a* of the first side 114*b* of the seat member 106 is decreased until stopper 110*b* contacts the underside of armrest 122 and limits the amount of backwards recline.

Figure 5D:
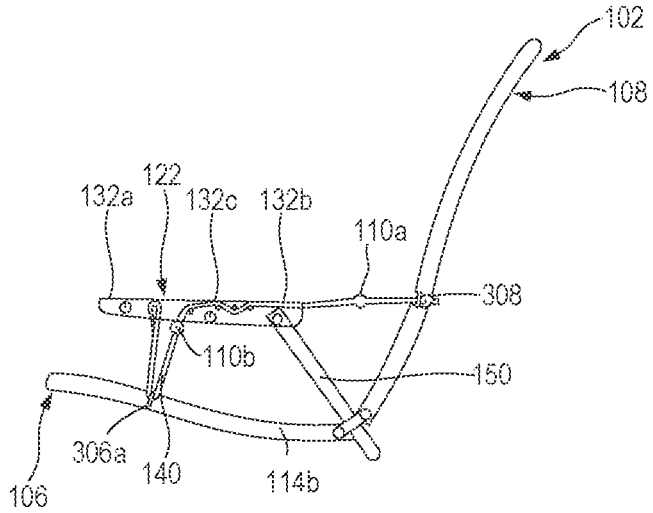
FIG. 5D illustrates a cutaway view of the first armrest described in FIG. 4D, in accordance with an embodiment of the present disclosure.

FIG. 5D illustrates a cutaway view of the first armrest described in FIG. 4D, in accordance with the embodiment of the present disclosure. For clarity, the front leg frame 128 and the back leg frame 130 are shown in FIG. 4D is not shown in FIG. 5D. In the reward rocking position, as the body support portion 102 moves rearward with respect to the armrest 122 the suspension member 150 rotates rearwards towards the back of the seating apparatus. In the reclined position, the linear distance between the second portion 132*b* of the first armrest 122 and the second secure member 308 of the backrest member 108 is increased. Correspondingly, the lateral distance between the first portion 132*a* of the first armrest 122 and the one first secure member 306*a* of the first side 114*b* of the seat member 106 is decreased until stopper 110*b* contacts the underside of armrest 122 and limits the amount of backwards recline.

Figure 6A:
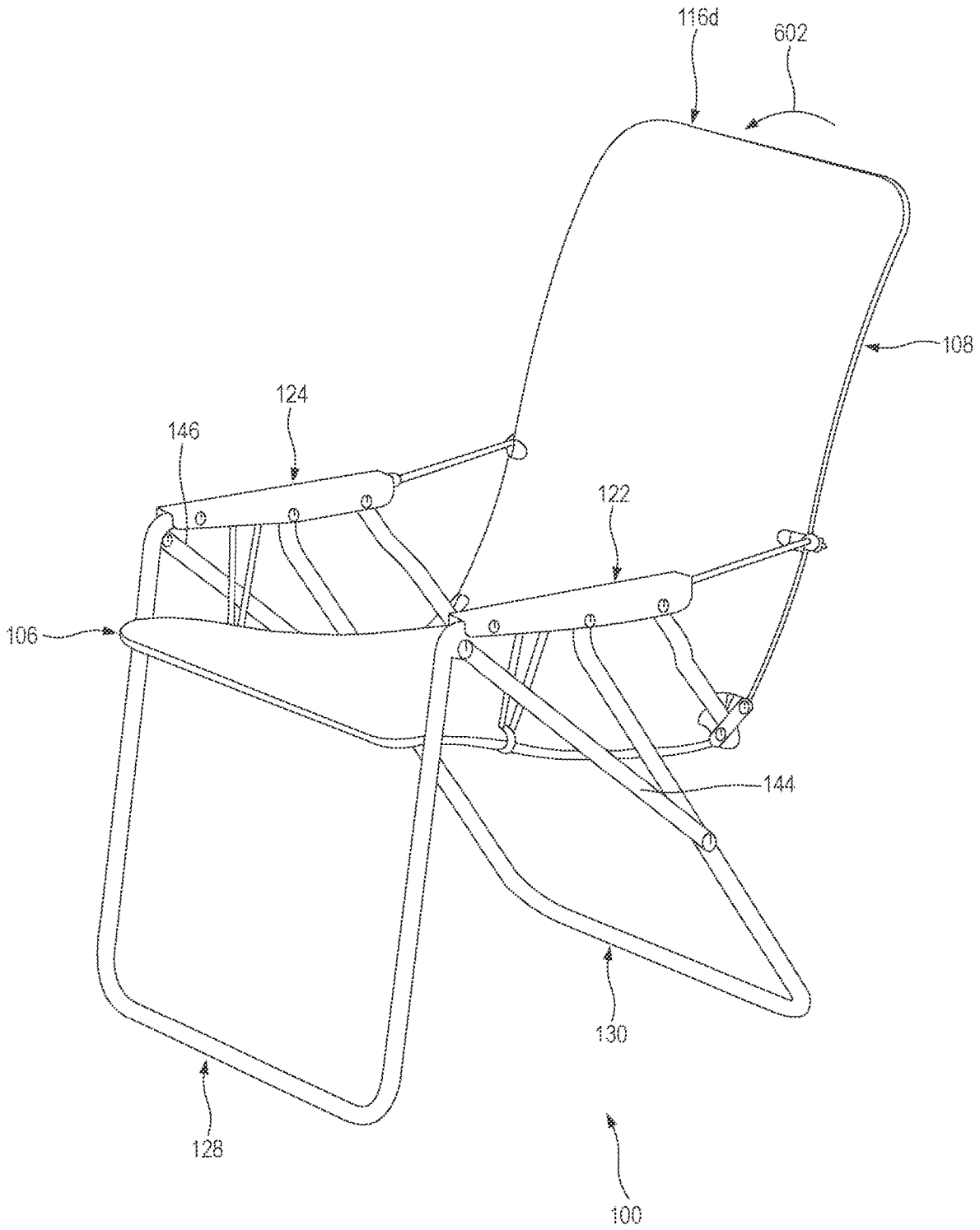
FIG. 6A illustrates a perspective view of the embodiment of the foldable rocking and reclining seating apparatus described in FIG. 1 in an open position.

FIG. 6A illustrates a perspective view of the embodiment of the foldable rocking and reclining seating apparatus 100 described in FIG. 1 in an open position ready for sitting.

Figure 6B:
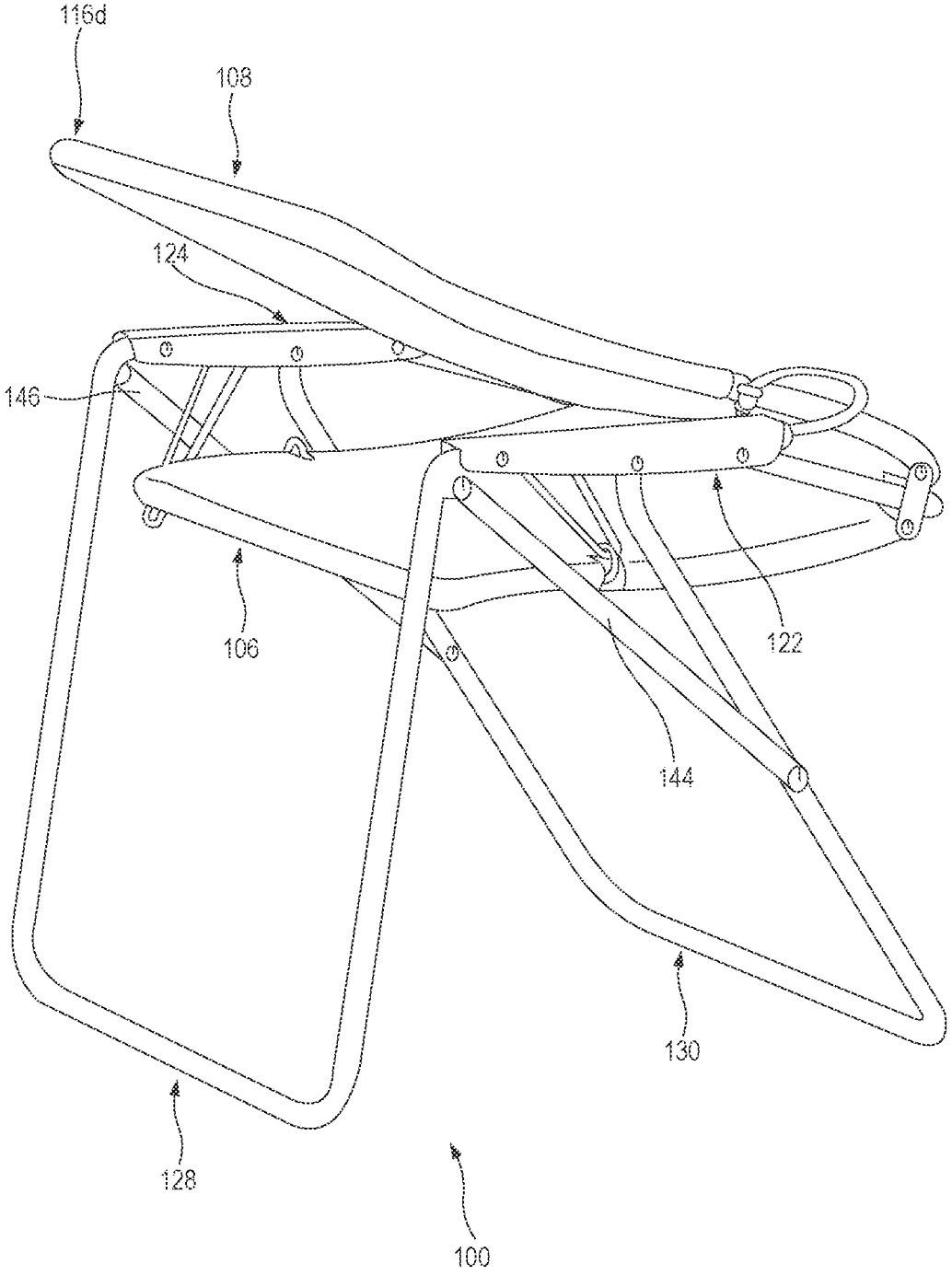
FIG. 6B illustrates a perspective view of the embodiment of the foldable rocking and reclining seating apparatus described in FIG. 1 in a half-folded position.

FIG. 6B illustrates a perspective view of the embodiment of the foldable rocking and reclining seating apparatus 100 described in FIG. 1 in a half-folded position. The folding of the seating apparatus 100 takes place at least through two movements. In the first movement, the backrest member 108 is tilted forwards with respect to the seat member 106 by applying force on the upper side 116*d* of the backrest member 108. In a second movement, the first front leg member 136*a* and the second front leg member 136*b* of the front leg frame 128 are pushed rearward with respect to the first armrest 122 and the second armrest 124. Further, the first support member 144 and the second suspension member 138 simultaneously push the first back leg member 138*a* and the second back leg member 138*b* of the back leg frame 130 to lie parallel to the first armrest 122 and the second armrest 124 in the compact storage configuration.

Figure 6C:
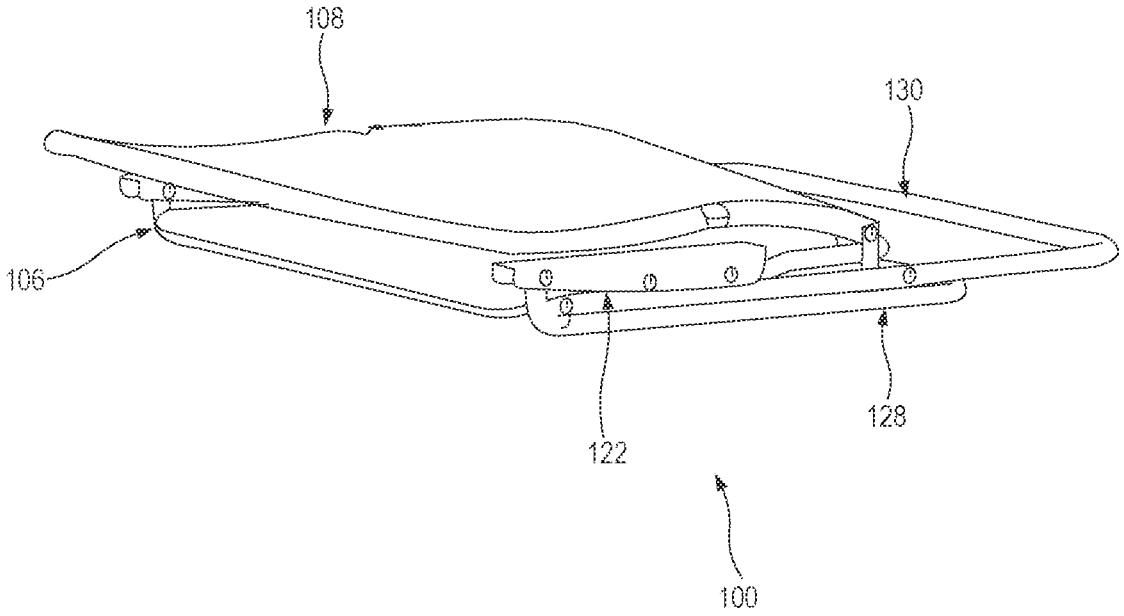
FIG. 6C illustrates a perspective view of the embodiment of the foldable rocking and reclining seating apparatus described in FIG. 1 in a fully folded position.

FIG. 6C illustrates a perspective view of the embodiment of the foldable rocking and reclining seating apparatus 100 described in FIG. 1 in a fully folded position. As shown, employing the first movement and the second movement, the seating apparatus 100 can be folded compactly for ease of shipping and transport.

The following embodiments show some variations on the preferred embodiment and demonstrate the variety of options that the basic mechanism for control of rocking reclining motion can be adapted to.

Figure 7:
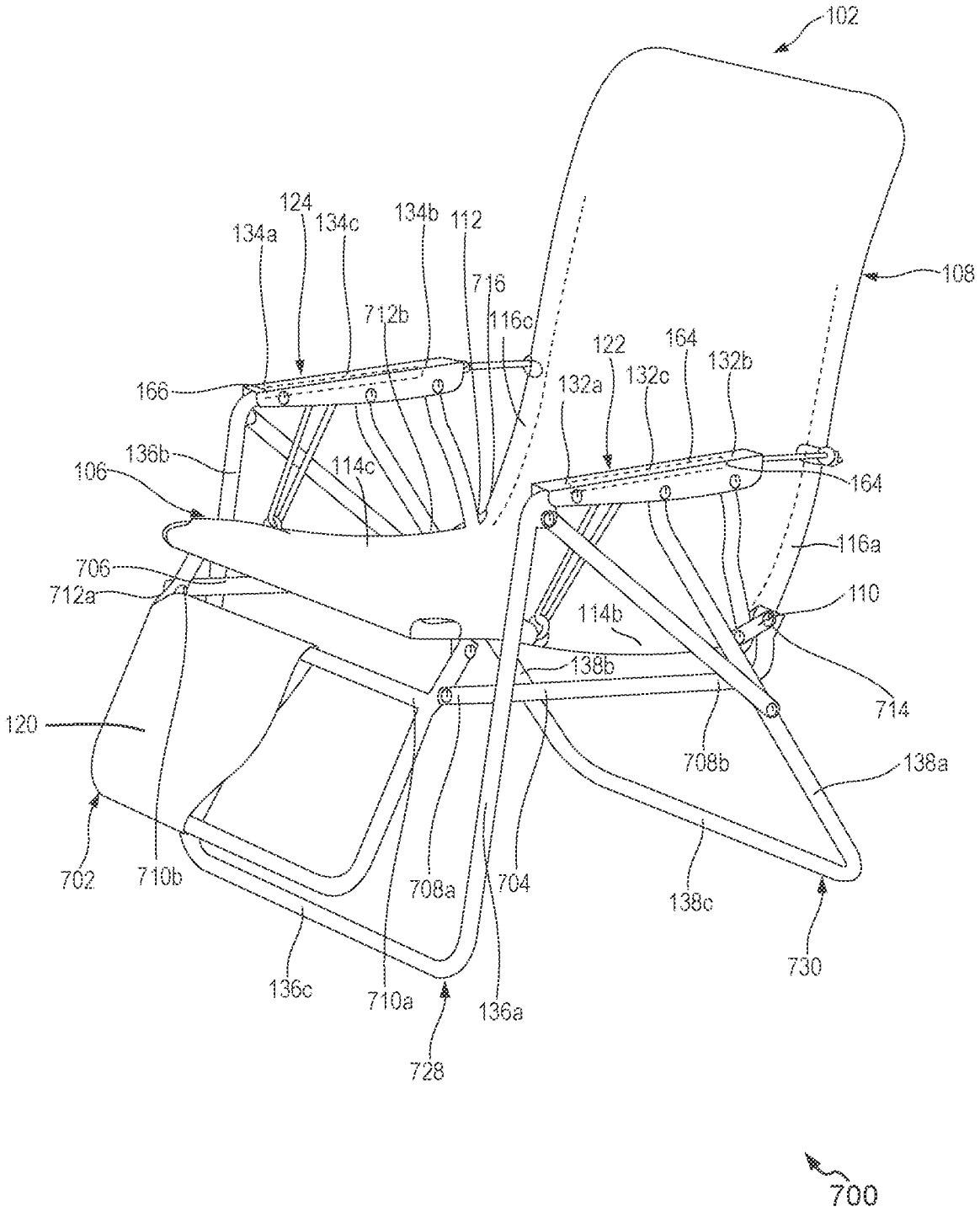
FIG. 7 illustrates a perspective view of the foldable rocking and reclining seating apparatus with a footrest member, in accordance with another embodiment of the present disclosure.

FIG. 7 illustrates a perspective view of a foldable rocking and reclining seating apparatus 700 with a footrest member 702 covered in flexible fabric 120, in accordance with another embodiment of the present disclosure. The seating apparatus 700 includes the footrest member 702 actuated by the reclining movement of the backrest member 108 to extend upward from under the seat member 106 when the backrest member 108 is reclined. The footrest member 702 is actuated by a pair of push bars 704, 706 and a pair of extensions 714, 716 extending down from the backrest 108.

The pair of push bars includes a first push bar 704 and a second push bar 706. The first push bar 704 is disposed underneath the first side 114*b* of seat member 106. The second push bar 706 is disposed underneath the second side 114*c* of the seat member 106. A first end 708*a* of the first push bar 704 is pivotally coupled with a first end 710*a* of the footrest member 702 and a first end 712*a* of the second push bar 706 is pivotally coupled with a second end 710*b* of the footrest member 702. Further, a second end 708*b* of the first push bar 704 is pivotally coupled with a first extension 714 and the first extension 714 is extended down from the bottom side 116*a* of the backrest member 108. Similarly, the second end 712*b* of the second push bar 706 is pivotally coupled with a second extension 716 and the second extension 716 is extended down from the bottom side 116*a* of the backrest member 108. The movement of the footrest member 702 actuated by the reclining movement of backrest member 108, is explained in detail in FIGS. 8A-8C.

Figure 8A:
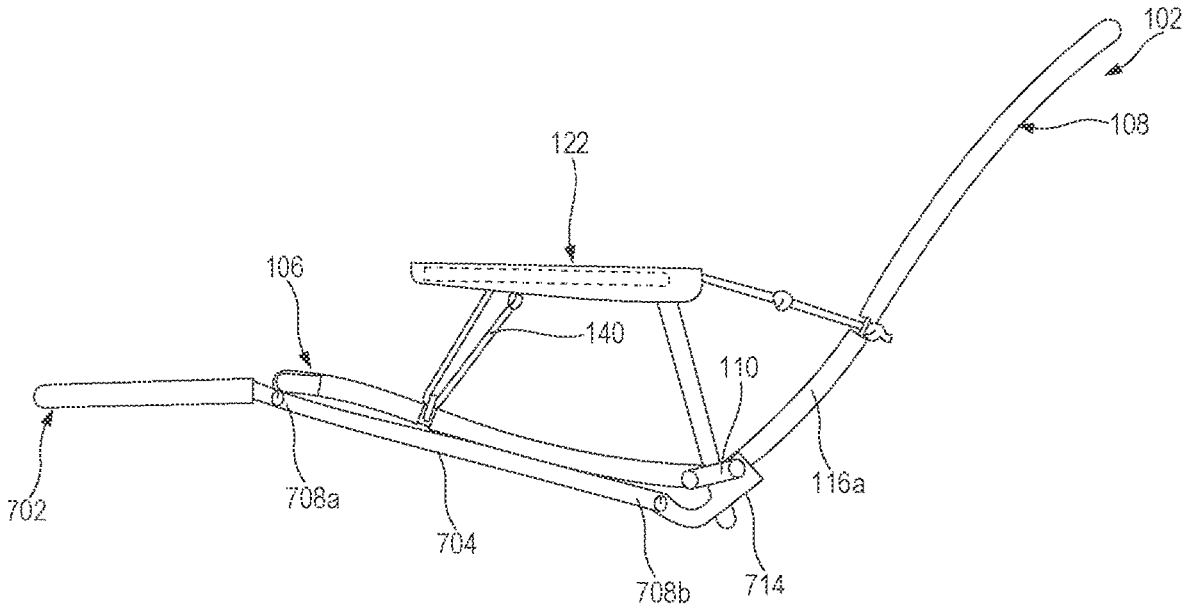
FIG. 8A illustrates a side view of an extension mechanism of the footrest member described in FIG. 7 in a reclined position, with the stationary frame not shown for clarity, in accordance with another embodiment of the present disclosure.

FIG. 8A illustrates a side view of an extension mechanism of the footrest member 702 described in FIG. 7 in a reclined position, in accordance with another embodiment of the present disclosure. For clarity, front leg frame 728 and rear leg frame 730 are not shown in FIGS. 8A, 8B, and 8C. As shown, when the backrest member 108 is reclined, the first push bar 704 is pushed forward by the first extension 714 extended down from the bottom side 116*a* of the backrest member 108, and simultaneously, the second push bar 706 is pushed forward by the second extension 716 extended down from the bottom side 116*a* of the backrest member 108. As a result, both the first push bar 704 and the second push bar 706 move forward (i.e., from the back side 114*a* to the front side 114*d* of the seat member 106). The forward movement of the first end 708*a* of the first push bar 704 and the forward movement of the first end 712*a* of the second push bar 706 pushes the footrest member 702 into a horizontal position to support the user's legs.

Figure 8B:
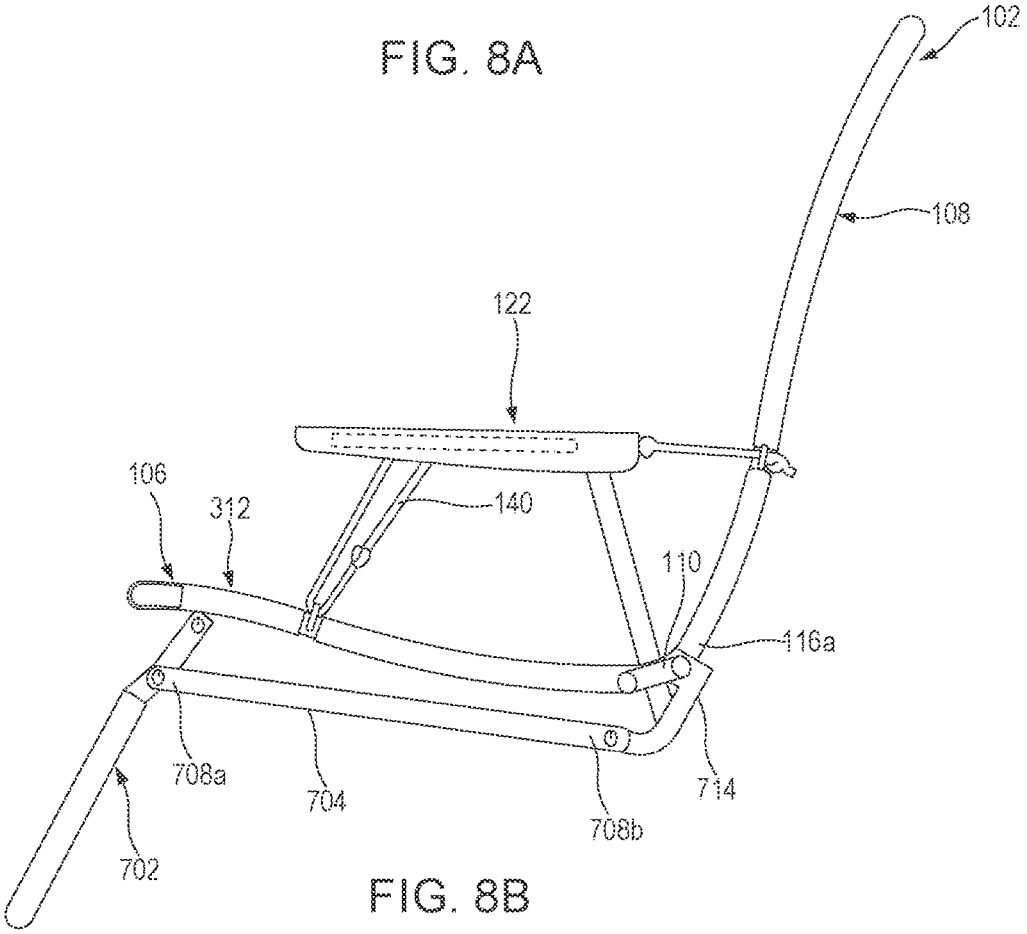
FIG. 8B illustrates a side view of the extension mechanism of the footrest member described in FIG. 7 in an upright position with the stationary frame not shown for clarity, in accordance with another embodiment of the present disclosure.

FIG. 8B illustrates a side view of the extension mechanism of the footrest member 702 described in FIG. 7 in an upright position, in accordance with another embodiment of the present disclosure. As shown, when the backrest member 108 moves in the upright position, the first push bar 704 is pulled rearward by the first extension 714 extended down from the bottom side 116*a* of backrest member 108 and simultaneously, the second push bar 706 is pulled rearward by the second extension 716 extended down from the bottom side 116*a* of backrest member 108. As a result, both the first push bar 704 and the second push bar 706 move rearward (i.e. from the front side 114*d* to the back side 114*a* of the seat member 106). The rearward movement of the first end 708*a* of the first push bar 704 and the rearward movement of the first end 712*a* of the second push bar 706 pulls the footrest member 702 into a downward position below seat member 106.

Figure 8C:
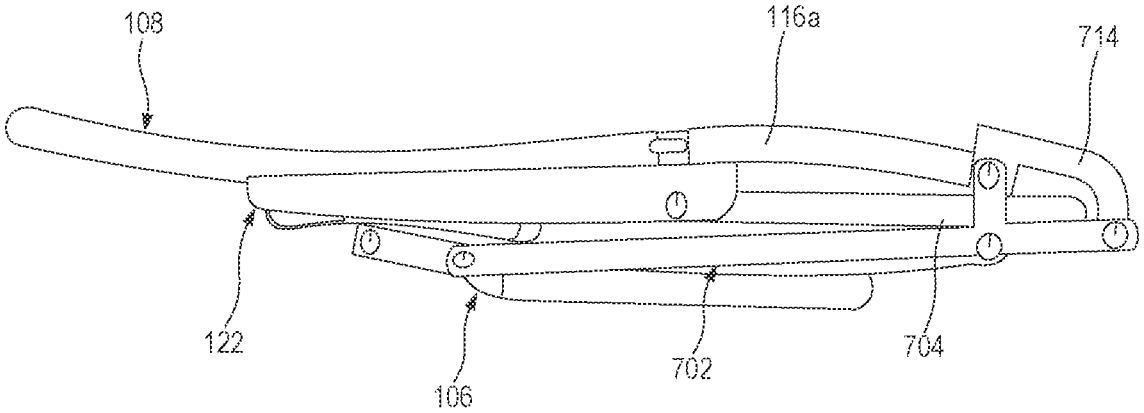
FIG. 8C illustrates a side view of the extension mechanism of the footrest member described in FIG. 7 in a fully folded position, with the stationary frame not shown for clarity, in accordance with another embodiment of the present disclosure.

FIG. 8C illustrates a side view of the extension mechanism of the footrest member 702 described in FIG. 7 in a folded position, in accordance with another embodiment of the present disclosure. As shown, when the backrest member 108 is folded over the seat member 106, the first push bar 704 is further pulled rearward by the first extension 714 extended down from the bottom side 116*a* of the backrest member 108 and simultaneously, the second push bar 706 is further pulled rearward by the second extension 716 extended down from the bottom side 116*a* of the backrest member 108. As a result, both the first push bar 704 and the second push bar 706 move farther rearward. The extreme rearward movement of the first end 708*a* of the first push bar 704 and the extreme rearward movement of the first end 712*a* of the second push bar 706 pulls the footrest member 702 underneath the seat member 106 and into an over lapping position.

In another embodiment, seat member 106 and the backrest member 108 of the body support portion 102 are formed using a rigid panel (best shown in FIG. 7). The rigid panel of the body support portion 102 allows the user to sit securely and comfortably. The panel may be made of suitable materials such as wood, sheet metal, plastic, etc. Geometrical and design aspects of the panel are similar to the previous embodiment (i.e., the frame structure 118 covered with the flexible fabric 120), and therefore they are not reiterated for the sake of brevity.

In yet another embodiment, both the frame structure 118 and the rigid panel may be used to form the body support portion 102. The body support portion includes the seat member 106 and the backrest member 108. In a non-limiting example, the rigid panel may be mounted onto frame structure 118 with screws to form the body support portion 102 that allows the user to seat securely and comfortably.

In each of the embodiment of the construction of the body support portion 102, the seat member 106 and the backrest member 108 may also include a cushioning member (not shown in FIG. 1) to provide comfort to the user using the additional cushioning effect to the body of the user. It is to be noted that one or more cushioning members may be temporarily or permanently joined to seat member 106 and the backrest member 108. In one example, a cushion made up of a cotton material provides maximum damping and minimum stiffness to the body of the user. In another example, memory foam may be used as a cushioning material to provide comfort to the body of the user.

In a non-limiting example, the body supporting portion 102 may be suspended from a fully assembled stationary frame that is not foldable. This embodiment will have the same rocking, reclining, rocking-reclining motion of the folding stationary frame examples without the compact portability and shipping benefits of folding embodiments. Fully assembled frames may have the benefits to the user of improved aesthetics and stronger structure.

Figure 9:
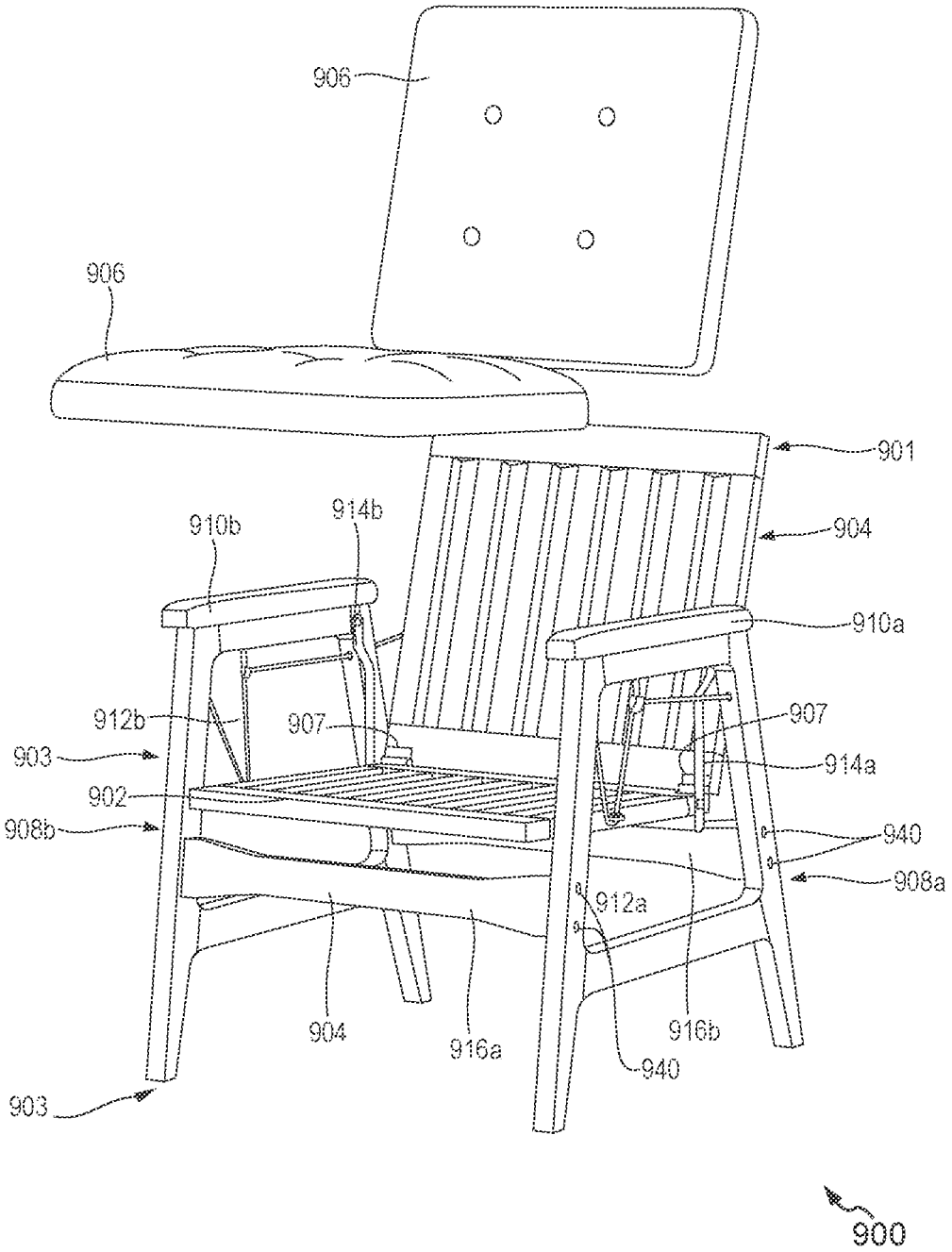
FIG. 9 illustrates a perspective view of a foldable rocking and reclining seating apparatus in an upright position, made of a rigid wooden seat panel and a rigid wooden backrest, in accordance with an embodiment of the present disclosure.

FIG. 9 shows that a seating apparatus 900 wherein the body support portion 902 is suspended within a stationary frame 903 that is not foldable. The body support portion 901 comprises a rigid wooden seat panel 902 is pivotally attached with hinges 907 along its rear edge to the bottom edge of a rigid wooden backrest panel 904. The rigid wooden seat panel 902 and the rigid wooden backrest panel 904 are covered with cushions 906 to enhance the comfort of the user sitting on the seating apparatus 900. The cushion 906 can be attached either temporarily or permanently to the rigid wooden seat panel 902 and/or the rigid wooden backrest panel 904. In one example, cushion 906 made of polyurethane foam provides maximum damping and minimum stiffness to the body of the user. A left wooden side leg frame 908*a* and a right wood side leg frame 908*b* respectively support a left armrest 910*a* and a right armrest 910*b*. The rigid wood seat panel 902 and the rigid wooden backrest panel 904 are suspended between left wooden side leg frame 908A and right wooden side leg frame 908*b* by a left flexible member 912*a* and a right flexible member 912*b* and a left suspension member 914*a* and a right suspension member 914*b*. A suspension cross member 914*c* rigidly connects the bottom ends of the left suspension member 914*a* and the right suspension member 914*b* to provide more lateral stability in the rocking motion. The left wooden side leg frame 908*a* and the right wooden side leg frame 908*b* are held apart and upright by a front cross member 916*a* and a rear cross member 916*b* which are bolted to the left wooden side leg frame 908*a* and the right wooden side leg frame 908*b* with bolts 940.

It should be noted that the attachment points of the left flexible member 912*a* and the right flexible member 912*b* are not located in the left armrest 910*a* and the right armrest 910*b* but are attached to the left wooden side leg frame 908*a* and the right wooden side leg frame 908*b* of each side. This illustrates that the left flexible member 912*a* and the right flexible member 912*b* do not have to be integral to the left armrest 910*a* and the right armrest 910*b* for the rocking reclining mechanism to function. Many attachment positions of the flexible members 912*a*, 912*b* and suspension members 914*a*, 914*b* to the stationary frame 903 that are located above the level of the rigid wooden seat member 902 will facilitate the rocking and reclining motion of the body support portion 901.

Figure 10:
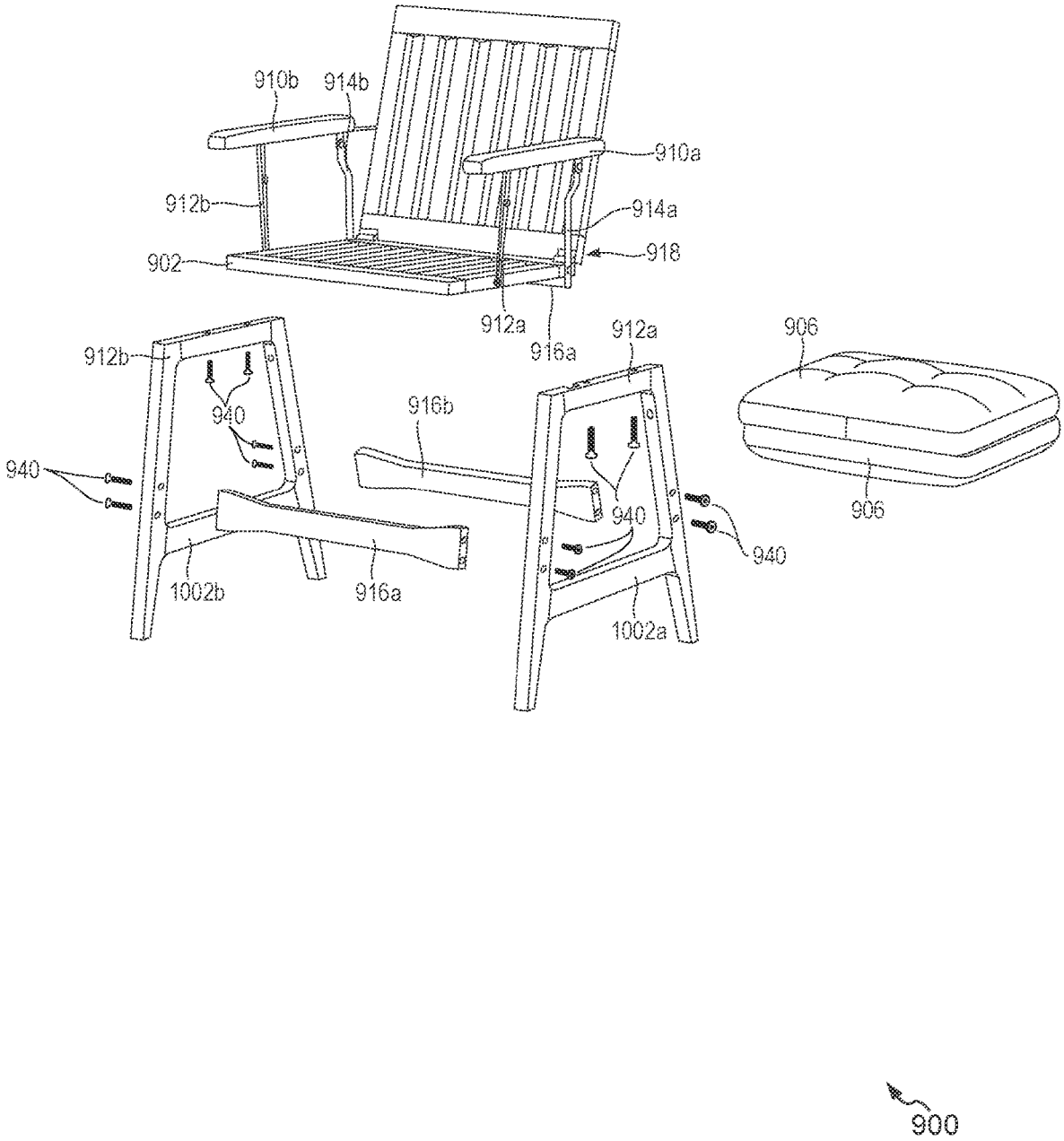
FIG. 10 illustrates a perspective view of a foldable rocking and reclining seating apparatus in a knockdown assembly, in accordance with an embodiment of the present disclosure.

The seating apparatus 900 of FIG. 9 is not a folding frame so it has the disadvantage of being a large volume to ship. FIG. 10 shows a knockdown assembly diagram for the seating apparatus 900 to describe how the seating apparatus 900 of this type can be disassembled to pack in a compact box and more efficiently shipped and yet be simple for the end user to assemble at home. A left side frame 1002*a* and a right-side frame 1002*b* are bolted to the front cross member 916*a* and the rear cross member 916*b*, with bolts 940. The seating apparatus 900 including the left armrest 910*a*, the right armrest 910*b*, the seat member 902, the backrest member 908, the left flexible member 912*a*, the right flexible member 912*b*, the left suspension member 914*a* and the right suspension member 914*b* are pre-assembled and are attached with bolts 940 on top of the left side frame 1002*a* and the right-side frame 1002*b*. The cushion 906 can be placed onto the rigid wooden seat panel 902 and the rigid wooden backrest panel 904 after they are assembled.

In one embodiment, the stationary frame 920 comprises a plurality of screws, bolts, or mechanical fasteners connecting the left leg frame 1002*a* and the right leg frame 1002*b* to the at least one of the front cross members 916*a* or the rear cross member 916*b*, to allow disassembly of the stationary frame to form a compact storage configuration, for compact shipping and storage.

Various embodiments of the disclosure, as discussed above, may be practiced with steps and/or operations in a different order, and/or with hardware elements in configurations, which are different from those which are disclosed. Therefore, although the disclosure has been described based upon these exemplary embodiments, it is noted that certain modifications, variations, and alternative constructions may be apparent and well within the scope of the disclosure.

Although various exemplary embodiments of the disclosure are described herein in a language specific to structural features and/or methodological acts, the subject matter defined in the appended claims is not necessarily limited to the specific features or acts described above. Rather, the specific features and acts described above are disclosed as exemplary forms of implementing the claims.

What is claimed is:

1. A reclining seating apparatus, comprising:

a body support portion suspended by pivoting connections and flexible members from first and second sides of a stationary frame; the body support portion comprising:

a seat member, a backrest member, and a connection link pivotally connecting a bottom side of the backrest member with a back side of the seat member facilitating the backrest member to attain a reclined position and an upright position relative to the seat member, the seat member including at least one secure member on each side to connect to the flexible members, the backrest member including at least one secure member on each side to connect to the flexible members;

the stationary frame comprising: a leg structure configured to hold a first armrest and a second armrest in fixed positions above the level of the seat member on a first side and a second side of the seat member, a first side and a second side of the stationary frame, each including at least one guide element for directing the flexible members;

pivoting connections connecting the first and second sides of the stationary frame to first and second sides of the body support portion, respectively;

a first flexible member configured to link the secure member on the first side of the seat member with guide elements on the first side of the stationary frame and continuing rearward to link the guide elements in the first side of the stationary frame with a secure member on the first side of the backrest member, and a second flexible member configured to link the secure member on the second side of the seat member with the guide element on the second side of the stationary frame and continuing rearward to link the guide element on the second side of the stationary frame with a secure member on the second side of the backrest member, wherein the pivoting connections in conjunction with first and second flexible members suspend the body support portion of the seating apparatus from the stationary frame of the seating apparatus while the first and second flexible members transfer the weight of a person sitting on the seat member into forward pressure on the backrest member allowing the user to adjust and control at least a reclining movement, or a rocking-reclining movement of the body support portion.

2. The seating apparatus of claim 1, wherein each of the pivoting connections from the stationary frame to the body support portion is a suspension element comprised of first and second suspension members joined at each lower end to a suspension crossbar, each suspension member pivotally connected to first and second sides of the body support portion at bottom portion of each suspension member and pivotally connected to first and second sides of the stationary frame at an upper end of each suspension member, said suspension members facilitating the back and forth rocking of the body support portion of the seating apparatus relative to the stationary frame of the seating apparatus.

3. The seating apparatus of claim 2, wherein the lower portion of the first suspension member and the lower portion of the second suspension member are attached to a first connection link and a second connection link, respectively, between the seat member and the backrest member.

4. The seating apparatus of claim 2, wherein the lower end of the first suspension member and the lower end of the second suspension member are pivotally attached to first and second sides of the backrest member.

5. The seating apparatus of claim 2, wherein the lower end of the first suspension member and the lower end of the second suspension member are pivotally attached to the first and the second sides of the seat member, respectively.

6. The seating apparatus of claim 1 further comprising at least one stopper fixedly attached to a flexible member, to limit a distance that the backrest member is allowed to travel while reclining or moving upright.

7. The seating apparatus of claim 1 wherein more than one section of a flexible member links the secure element on the seat member to the stationary frame and the flexible member slides through at least one secure element.

8. The seating apparatus of claim 1 wherein more than one section of a flexible member links the secure element on the backrest member to the stationary frame and the flexible member slides through at least one secure element.

9. The seating apparatus of claim 1, wherein the body support portion comprises at least a frame structure, a flexible fabric, a panel, or any combination thereof.

10. The seating apparatus of claim 1, further comprising a plurality of guide elements positioned in the first armrest and the second armrest, configured at least to direct the first flexible member in the first armrest and at least to direct the second flexible member in the second armrest.

11. The seating apparatus of claim 1, wherein the stationary frame comprises: a front leg frame pivotally coupled to the first armrest and the second armrest; and a back leg frame pivotally coupled to the first armrest and the second armrest, such that the front leg frame and the back leg frame can be folded to lie adjacent to each other and adjacent to the first armrest and second armrest to form a compact storage configuration.

12. The seating apparatus of claim 11, wherein the seat member folds down to lie flat against the backrest member when the body supporting portion is folded and then also lies flat against folded front leg frame and folded back leg frame forming the compact storage configuration for the seating apparatus.

13. The seating apparatus of claim 11, wherein the stationary frame comprises at least a first support member and a second support member, wherein the first support member is configured at least to link a first front leg member with a first back leg member and the second support member is configured at least to link a second front leg member with a second back leg member, said support members reinforcing a structure of the seating apparatus in an open configuration and facilitating folding of the seating apparatus by guiding the front leg frame into the folded position while the back leg frame is being folded.

14. The seating apparatus of claim 1, wherein the stationary frame comprises a first leg frame having a front leg and back leg, a second leg frame having a front leg and a back leg, at least one crossbar member connecting the first leg frame to the second leg frame.

15. The seating apparatus of claim 1, further comprising a locking mechanism within the stationary frame that immobilizes the first flexible member and the second flexible member from sliding relative to the stationary frame.

16. The seating apparatus of claim 15, wherein the locking mechanism comprises a threaded knob.

17. The seating apparatus of claim 1, further comprising an extension member extending down from the bottom of the backrest and pivotally connects to a first end of a push bar, and the second end of the push bar pivotally connects to a footrest member pivotally attached to a front edge of the seat member, wherein when the backrest is reclined, the extension member pushes the push bar forward which then pushes the footrest upwards from under the seat to a roughly horizontal position comfortable for supporting a user's feet.

* * * * *